US008678369B2

(12) United States Patent
Hidaka et al.

(10) Patent No.: US 8,678,369 B2
(45) Date of Patent: Mar. 25, 2014

(54) SKEW CORRECTION DEVICE, IMAGE FORMING SYSTEM, AND SKEW CORRECTION METHOD

(75) Inventors: Makoto Hidaka, Tokyo (JP); Takamasa Matsumoto, Miyagi (JP); Nobuyoshi Suzuki, Tokyo (JP); Kei Sasaki, Miyagi (JP); Kiyoshi Hata, Tokyo (JP); Shingo Matsushita, Tokyo (JP); Takashi Saito, Kanagawa (JP); Akihiro Musha, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/533,444

(22) Filed: Jun. 26, 2012

(65) Prior Publication Data

US 2013/0001848 A1 Jan. 3, 2013

(30) Foreign Application Priority Data

Jun. 30, 2011 (JP) ..... 2011-146410

(51) Int. Cl.
*B65H 9/10* (2006.01)

(52) U.S. Cl.
USPC .... 270/58.17; 270/58.07; 270/32; 270/58.27; 270/58.12

(58) Field of Classification Search
USPC ..... 270/32, 37, 45, 58.07, 58.12, 58.17, 270/58.27; 271/271, 275, 277
See application file for complete search history.

(56) References Cited

U.S. PATENT DOCUMENTS

| | | | | |
|---|---|---|---|---|
| 6,575,447 | B2 * | 6/2003 | Yoshie et al. | 270/58.07 |
| 7,744,076 | B2 * | 6/2010 | Suzuki et al. | 270/58.11 |
| 8,162,306 | B2 | 4/2012 | Suzuki et al. | |
| 8,186,663 | B2 | 5/2012 | Suzuki et al. | |
| 2005/0147487 | A1 * | 7/2005 | Wakabayashi et al. | 412/9 |
| 2009/0001648 | A1 * | 1/2009 | Wakabayashi et al. | 270/58.12 |
| 2009/0261521 | A1 * | 10/2009 | Okamoto et al. | 270/37 |
| 2010/0148417 | A1 | 6/2010 | Suzuki et al. | |
| 2010/0239393 | A1 | 9/2010 | Suzuki et al. | |
| 2010/0303585 | A1 | 12/2010 | Asami et al. | |
| 2010/0310340 | A1 | 12/2010 | Suzuki et al. | |
| 2011/0103863 | A1 | 5/2011 | Asami et al. | |
| 2011/0103921 | A1 | 5/2011 | Suzuki et al. | |
| 2011/0140335 | A1 * | 6/2011 | Abe | 270/4 |
| 2011/0229287 | A1 | 9/2011 | Suzuki | |
| 2012/0087765 | A1 | 4/2012 | Suzuki | |

FOREIGN PATENT DOCUMENTS

JP 4134854 B2 6/2008

OTHER PUBLICATIONS

English language abstract for patent publication No. JP-2005-082302 which corresponds to JP-4134854-B2.

* cited by examiner

*Primary Examiner* — Leslie A Nicholson, III
(74) *Attorney, Agent, or Firm* — Harness, Dickey & Pierce, P.L.C.

(57) ABSTRACT

A skew correction device for aligning a booklet that is a folded bundle of sheets on a conveying path includes a first member against which a leading end of the booklet abuts in a conveying direction; a second member configured to push a trailing end of the booklet in the conveying direction so that the leading end of the booklet abuts against the first member; and a deflection generating member configured to deflect the booklet downward when the trailing end is pushed.

6 Claims, 16 Drawing Sheets

SKEW CORRECTION DEVICE, IMAGE FORMING SYSTEM, AND SKEW CORRECTION METHOD

CROSS-REFERENCE TO RELATED APPLICATION

The present application claims priority to and incorporates by reference the entire contents of Japanese Patent Application No. 2011-146410 filed in Japan on Jun. 30, 2011.

BACKGROUND OF THE INVENTION

1. Field of the Invention

The present invention relates to a skew correction device, an image forming system, and a skew correction method.

2. Description of the Related Art

There are widely known sheet post-processing apparatuses each of which is disposed on the downstream side of an image forming apparatus main unit and performs post-processing such as binding on recording sheets or the like output from the image forming apparatus. Nowadays, such sheet post-processing apparatuses have been multifunctionalized, and generally perform a bookbinding process in which not only conventional edge binding but also saddle-stitching is performed. In some of the saddle-stitching bookbinding processes, a cutter cuts an edge of a bound booklet in order to further improve output quality.

In the cutting process of such a cutter, the booklet is conveyed by a conveying unit, such as a belt, and subjected to a skew correction by being pressed from the trailing end side thereof in the sheet conveying direction to be placed in contact with an abutting stopper placed in accordance with factors such as a size and an cutting amount of the booklet. For example, Japanese Patent No. 4134854 discloses such a skew correction technique.

In Japanese Patent No. 4134854, a leading end in the conveying direction of a booklet carried onto a booklet placing table is received by a pressing member of a booklet conveying unit. The pressing member is moved to place a trailing end in the conveying direction of the booklet in contact with a reference alignment member that can be turned up and down, and thus, a skew in the conveying direction of the booklet is corrected. The booklet is pressed by a pressing unit while being in contact with the reference alignment member, and thus is inserted into a cutter while maintaining the attitude when being in contact with the reference alignment member, and a cutting process is performed.

According to Japanese Patent No. 4134854, as described above, the skew in the conveying direction of the booklet is corrected by placing the trailing end in the conveying direction of the booklet in contact with the reference alignment member that can be turned up and down. However, although the booklet is not smeared or wrinkled due to friction between the belt and the booklet when the booklet is carried by the belt or the like and corrected in the skew thereof from above and below, it is not always possible to successfully place the booklet in contact with the reference alignment member due to deflection or buckling toward upside of the booklet occurring when the pressing member presses the booklet, because there is no control member at the upside of the booklet.

More specifically, when skew correction and positioning of the booklet is performed, the booklet is placed in contact with a positioning stopper by a trailing end jogger plate (pressing plate) or the like and subjected to the skew correction. When the trailing end jogger pushes the trailing end (end face side) of the booklet, a deflection may occur resulting in a buckling in an uncontrolled direction of the booklet depending on the sheet type and stiffness of the booklet, and thus, there is a case in which the booklet is difficult to be pressed in the horizontal direction. In such a case, the skew correction of the booklet is not achieved because a predetermined amount against the abutting stopper is not obtained. In the invention disclosed in Japanese Patent No. 4134854, the uncontrolled direction corresponds to the upside of the booklet.

This will be described specifically. FIGS. 20 and 21 illustrate the states of a conventional general skew correction. In FIG. 20, a guide plate 318 for a booklet BT is located only below the booklet BT, and the booklet BT moves along the upper surface of the guide plate 318. FIG. 20 illustrates an operation when the booklet BT is subjected to the skew correction by being pushed by a jogger 319 to the side of a positioning stopper 317 located on the downstream side of the guide plate 318; (a) illustrates a state in which the booklet BT is in an initial position; (b) illustrates a state in which the booklet BT is moving; and (c) illustrates a state in which the leading end of the booklet BT abuts against the positioning stopper 317, and subjected to the skew correction. Note that, in this specification, the term "abut" means bumping against an object and maintaining the abutting (contacting) state.

The jogger 319 pushes the end face side (trailing-end side) of the booklet BT in the direction indicated by arrow D1. The pushing amount is an amount L1 determined by factors such as the size, the number of sheets, and the type of sheet of the booklet BT. The amount L1 is longer than a theoretical distance L2 from the leading end of the booklet to the positioning stopper 317 by a predetermined amount ($L1>L2+\alpha$). By this setting, the booklet BT can be pressed by the predetermined amount after the leading end of the booklet BT has abutted against the positioning stopper 317, whereby the skew is corrected even if the booklet BT is obliquely traveling.

FIG. 21 illustrates an operation in the case in which the skew correction of the booklet BT is not successfully performed. Illustrated in (a) of FIG. 21 is a state in which the booklet BT is in the initial position; illustrated in (b) of FIG. 21 is a state in which the booklet BT is moving; and illustrated in (c) of FIG. 21 is a state in which the leading end of the booklet BT is supposed to abut against the positioning stopper 317, positioned, and skew corrected, but is actually not.

The surface of the jogger 319 for pushing the end face side of the booklet BT has generally a flat-surface shape. However, some types of sheets lack stiffness, and in that case, as illustrated in FIG. 20B, a force in the horizontal direction (direction of arrow D1) acts above the booklet BT because of the lack of stiffness. Consequently, a deflection is produced by this horizontal force, and the booklet BT buckles as illustrated in FIG. 21C. As a result, the horizontal moving amount of the booklet BT becomes smaller, whereby the positioning cannot be performed correctly. When the positioning is not performed correctly, the skew correction (alignment) of the booklet cannot be performed either.

Therefore, there is a need for a skew correction to be performed without particularly adding a controlling unit, such as a control plate, when correcting a skew of a booklet by pushing the trailing end of the booklet.

SUMMARY OF THE INVENTION

It is an object of the present invention to at least partially solve the problems in the conventional technology.

According to an embodiment, there is provided a skew correction device for aligning a booklet that is a folded bundle of sheets on a conveying path. The skew correction device includes a first member against which a leading end of the booklet abuts in a conveying direction; a second member configured to push a trailing end of the booklet in the conveying direction so that the leading end of the booklet abuts against the first member; and a deflection generating member configured to deflect the booklet downward when the trailing end is pushed.

According to another embodiment, there is provided an image forming system that includes the skew correction device according to the above embodiment.

According to still another embodiment, there is provided a skew correction method for aligning a booklet that is a folded bundle of sheets on a conveying path. The skew correction method includes projecting a first member on the conveying path; pushing a trailing end of the booklet with a second member against the first member projecting on the conveying path so that a leading end of the booklet abuts against the first member; and deflecting the booklet downward when the trailing end of the booklet is pushed at the pushing.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is an operation explanatory diagram of the saddle-stitching bookbinding apparatus illustrating a state when a bundle of sheets is carried in;

FIG. 10 is an operation explanatory diagram illustrating the cutting operation of the cutter, presented to illustrate an operation of pressing the stopped booklet down to a certain thickness after being carried in;

DETAILED DESCRIPTION OF THE PREFERRED EMBODIMENTS

Figure 1:
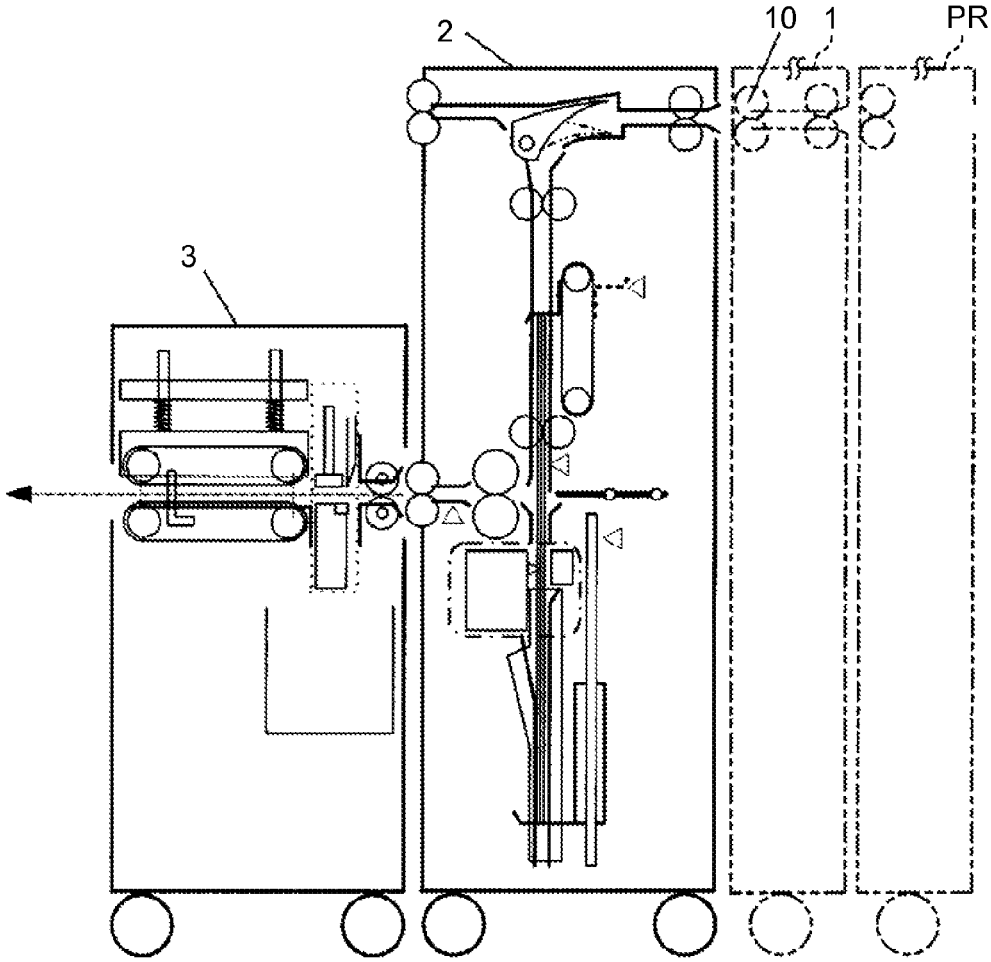
FIG. 1 is a diagram illustrating a system structure of an image forming system including an image forming apparatus and a plurality of sheet post-processing apparatuses in an embodiment of the present invention.

An embodiment of the present invention will be described below with reference to the accompanying drawings. Note that, in the description given below, the same parts will be given the same reference numerals, and duplicate explanations will be omitted as appropriate.

In this specification, the term "sheet" means one type of sheet-like recording media such as a sheet of paper, a recording sheet, or a transfer sheet.

FIG. 1 is a diagram illustrating a system structure of an image forming system including an image forming apparatus PR and a plurality of sheet post-processing apparatuses (1, 2, and 3) in the embodiment of the present invention. In the present embodiment, first to third sheet post-processing apparatuses 1, 2, and 3 are connected in this order in subsequent stages of the image forming apparatus PR.

The first sheet post-processing apparatus 1 is a sheet post-processing apparatus that has a function of generating a bundle of sheets and includes a stack unit that receives sheets from the image forming apparatus PR one by one, sequentially stacks and aligns the sheets, and generates a bundle of sheets. The first sheet post-processing apparatus 1 discharges the bundle of sheets from sheet bundle discharging rollers 10 to the second sheet post-processing apparatus 2 in the subsequent stage. The second sheet post-processing apparatus 2 is a saddle-stitching bookbinding apparatus that receives the bundle of sheets that has been fed, and performs saddle-stitching and middle-folding on the bundle of sheets (in this specification, the second sheet post-processing apparatus 2 is sometime referred to as the "saddle-stitching bookbinding apparatus 2").

The saddle-stitching bookbinding apparatus 2 discharges the bound booklet to the third sheet post-processing apparatus 3. The third sheet post-processing apparatus 3 is a cutter that cuts the ends of the sheets that have been fed (in this specification, the third sheet post-processing apparatus 3 is sometimes referred to as the "cutter 3"). The booklet subjected to the cutting process in the cutter 3 is directly discharged out of the cutter, and stacked on a discharge tray (not illustrated). Alternatively, if another sheet post-processing apparatus is further connected in the subsequent stage, the booklet is directly discharged to the another sheet post-processing apparatus. The image forming apparatus PR forms a visible image on a sheet-like recording medium based on received image data or image data of a scanned image, and examples of the image forming apparatus PR include a copying machine, a printer, a facsimile apparatus, and a digital MFP provided with at least two of the functions of these devices.

Figure 2:
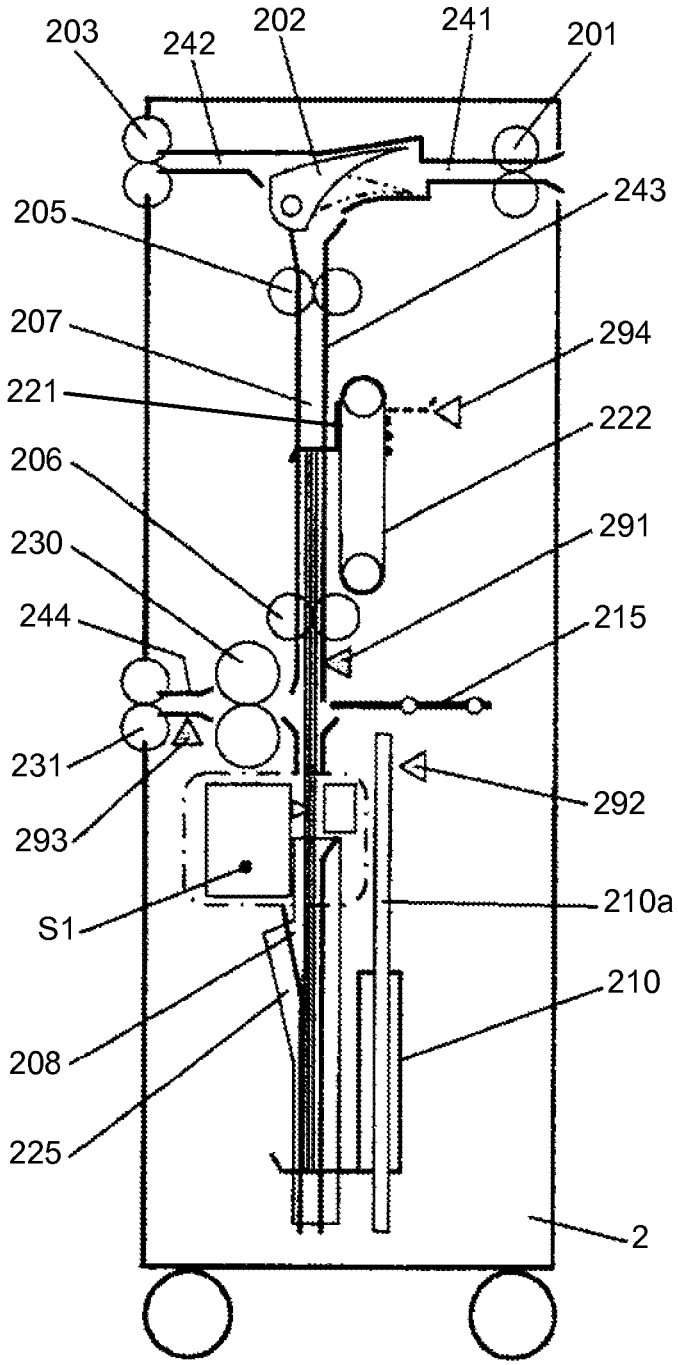
FIG. 2 is a diagram illustrating a detailed structure of a second sheet post-processing apparatus (saddle-stitching bookbinding apparatus) in FIG. 1.

FIG. 2 is a diagram illustrating a detailed structure of the saddle-stitching bookbinding apparatus 2 in FIG. 1. In this diagram, the saddle-stitching bookbinding apparatus 2 includes an entrance conveying path 241, a sheet-through conveying path 242, and a middle-folding conveying path 243. The uppermost stream portion in the sheet conveying direction of the entrance conveying path 241 is provided with entrance rollers 201, through which the aligned bundle of sheets is carried in from the sheet bundle discharging rollers 10 of the first sheet post-processing apparatus 1. Note that, in the description given below, the upstream side in the sheet conveying direction will be called simply the upstream side, and the downstream side in the sheet conveying direction will be called simply the downstream side.

A bifurcating claw 202 is provided on the downstream side of the entrance rollers 201 in the entrance conveying path 241. The bifurcating claw 202 is placed in the horizontal direction in the diagram, and switches the conveying direction of the bundle of sheets to the sheet-through conveying path 242 or the middle-folding conveying path 243. The sheet-through conveying path 242 is a conveying path that extends horizontally from the entrance conveying path 241 and guides the bundle of sheets to a post-processing apparatus or a discharge tray (both not illustrated) in the subsequent stage. The bundle of sheets is discharged to the subsequent stage by upper discharging rollers 203. The middle-folding conveying path 243 is a conveying path that extends vertically downward from the bifurcating claw 202 and is used for performing saddle-stitching and middle-folding on the bundle of sheets.

The middle-folding conveying path 243 includes an upper bundle-conveying guide plate 207 that guides the bundle of sheets above a folding plate 215 for middle folding, and a lower bundle-conveying guide plate 208 that guides the bundle of sheets below the folding plate 215. The upper bundle-conveying guide plate 207 is provided, from the top, with upper bundle-conveying rollers 205, a trailing end tapping claw 221, and lower bundle-conveying rollers 206. The trailing end tapping claw 221 is mounted in a standing manner on a trailing end tapping claw drive belt 222 driven by a driving motor (not illustrated). The trailing end tapping claw 221 aligns the bundle of sheets by tapping the trailing end of the bundle of sheets to the side of a movable fence (to be described later) using a reciprocating rotational motion of the drive belt 222. When the bundle of sheets is carried in and when the bundle of sheets is raised for middle folding, the trailing end tapping claw 221 is retracted from the middle-folding conveying path 243 on the upper bundle-conveying guide plate 207 (to a position indicated by a dashed line in FIG. 2).

A reference numeral 294 represents a trailing end tapping claw HP sensor for detecting a home position of the trailing end tapping claw 221. The trailing end tapping claw HP sensor detects, as the home position, the position indicated by the dashed line in FIG. 2 to which the trailing end tapping claw 221 is retracted from the middle-folding conveying path 243. The trailing end tapping claw 221 is controlled with reference to the home position.

The lower bundle-conveying guide plate 208 is provided, from the top, with a saddle-stitching stapler S1, a pair of saddle-stitching jogger fences 225, and a movable fence 210. The lower bundle-conveying guide plate 208 is a guide plate that receives the bundle of sheets fed through the upper bundle-conveying guide plate 207, that is arranged in the width direction thereof with the pair of saddle-stitching jogger fences 225, and that is provided therebelow with the vertically movable fence 210 that abuts against the leading end of the bundle of sheets and supports the bundle of sheets.

The saddle-stitching stapler S1 is a stapler that staples a central portion of the bundle of sheets. The movable fence 210 moves in the vertical direction while supporting the leading end of the bundle of sheets, and positions the center position of the bundle of sheets in a position that faces the saddle-stitching stapler S1, in which position a stapling process, that is, the saddle stitching is performed. The movable fence 210 is supported by a movable fence drive mechanism 210*a*, and is movable from the position of a movable fence HP sensor 292 illustrated above in the diagram to the lowest position. The movable range of the movable fence against which the leading end of the bundle of sheets abuts ensures a sufficient travel to process the bundle of sheets having a size varying from a minimum size to a maximum size that can be handled by the saddle-stitching bookbinding apparatus 2. Note that, for example, a rack and pinion mechanism is used as the movable fence drive mechanism 210*a*.

The folding plate 215, a pair of folding rollers 230, a discharged paper conveying path 244, and lower discharging rollers 231 are provided between the upper and the lower bundle-conveying guide plates 207 and 208, that is, near a central portion of the middle-folding conveying path 243. The folding plate 215 can make a reciprocating motion in the horizontal direction in the diagram. A nip of the pair of folding rollers 230 is located in the direction of motion during folding operation, and the discharged paper conveying path 244 is placed in the extension beyond the nip. The lower discharging rollers 231 are provided at the lowermost stream of the discharged paper conveying path 244, and discharge the folded bundle of sheets to the subsequent stage.

A bundle of sheets detecting sensor 291 is provided on the lower end side of the upper bundle-conveying guide plate 207, and detects the leading end of the bundle of sheets that is carried into the middle-folding conveying path 243 and passes through a middle folding position. A folded portion passage sensor 293 is provided on the discharged paper conveying path 244, and detects the leading end of the middle-folded bundle of sheets, thereby recognizing the passage of the bundle of sheets.

In the saddle-stitching bookbinding apparatus 2 structured as schematically illustrated in FIG. 2, a saddle-stitching and middle-folding operation is performed as illustrated in operation explanatory diagrams, FIGS. 3 to 7. That is, when the saddle-stitching and middle-folding operation is selected from an operation panel PN (refer to FIG. 15) of the image forming apparatus PR, the bundle of sheets for which the saddle-stitching and middle-folding operation is selected is guided toward the middle-folding conveying path 243 by a counterclockwise biasing operation of the bifurcating claw 202. The bifurcating claw 202 is driven by a solenoid. The bifurcating claw 202 may be driven by a motor instead of the solenoid.

Figure 3:
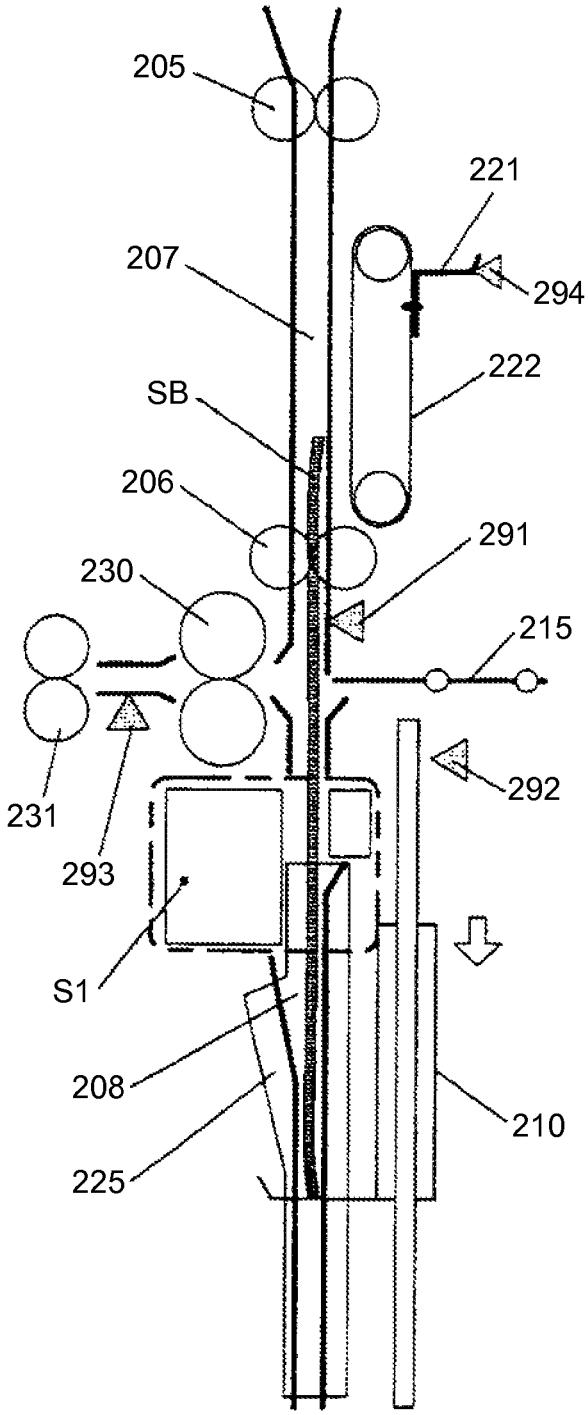

The bundle of sheets SB fed into the middle-folding conveying path 243 is conveyed downward through the middle-folding conveying path 243 by the entrance rollers 201 and the upper bundle-conveying rollers 205. After the bundle of sheets detecting sensor 291 has recognized the passage of the bundle of sheets SB, the bundle of sheets SB is conveyed by the lower bundle-conveying rollers 206 to a position in which the leading end of the bundle of sheets SB abuts against the movable fence 210 as illustrated in FIG. 3. In this process, the movable fence 210 stands by in a stopping position that differs depending on sheet size information, that is, size information in the conveying direction of each bundle of sheets SB in this case, received from the image forming apparatus PR. As illustrated in FIG. 3, the lower bundle-conveying rollers 206 sandwich the bundle of sheets SB in a nip thereof, and the trailing end tapping claw 221 stands by in the home position.

Figure 4:
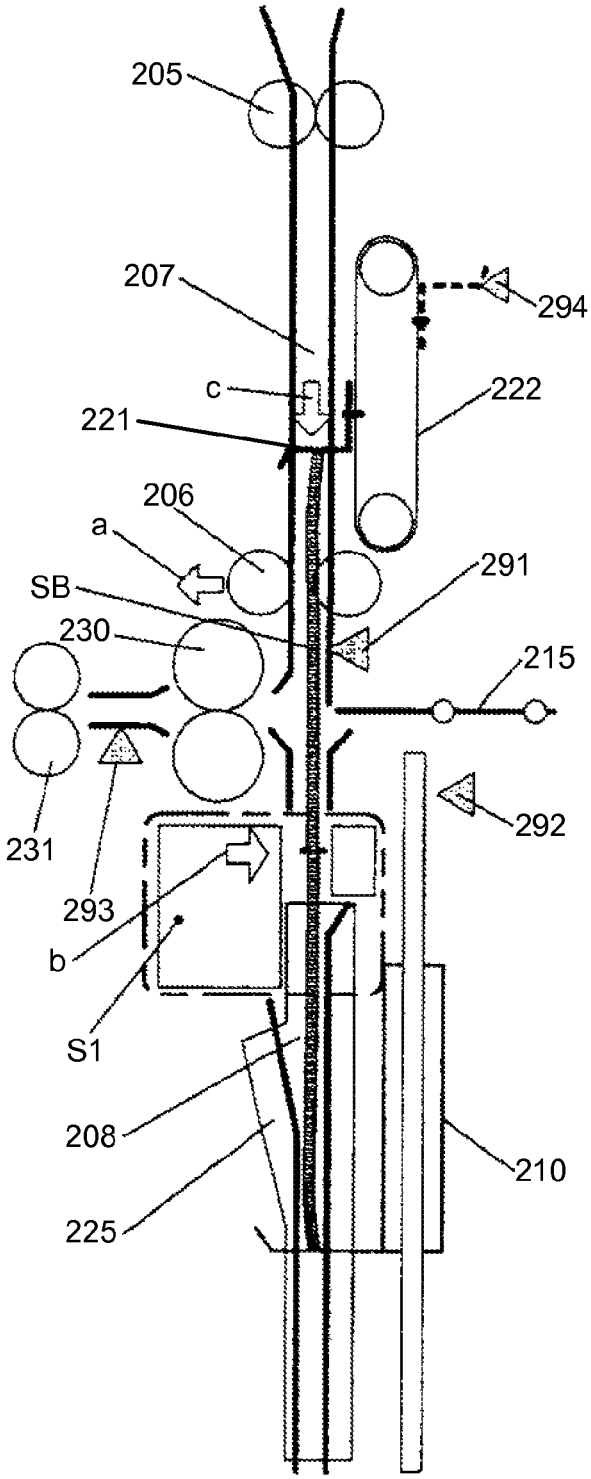
FIG. 4 is an operation explanatory diagram of the saddle-stitching bookbinding apparatus illustrating a state when the bundle of sheets is saddle-stitched.

In this state, as illustrated in FIG. 4, when the sandwiching pressure of the lower bundle-conveying rollers 206 is released (in the direction of arrow a), and the bundle of sheets is stacked with the leading end thereof abutting against the movable fence 210 and with the trailing end thereof being freed, the trailing end tapping claw 221 is driven to tap the trailing end of the bundle of sheets SB, thus performing a final alignment in the conveying direction (in the direction of arrow c).

Next, the saddle-stitching jogger fences 225 performs an aligning operation in the width direction (the direction perpendicular to the sheet conveying direction), and the movable fence 210 and the trailing end tapping claw 221 perform an aligning operation in the conveying direction, thus completing the aligning operations in the width direction and the conveying direction of the bundle of sheets SB. In these operations, the alignment is performed by adjusting the pressing amounts of the trailing end tapping claw 221 and the saddle-stitching jogger fences 225 to optimal values using the information on the sheet size, information about the number of sheets in the bundle, and information about the thickness of the bundle of sheets.

If the bundle is thick, the space in the conveying path is reduced, and it often happens that the alignment operation cannot be performed completely in one time. Accordingly, in such a case, the number of times of the aligning operations is increased. In this manner, a better alignment state can be achieved. As the number of sheets accumulates, the time for sequentially stacking the sheets increases on the upstream side, and thus, the time for receiving the next bundle of sheets SB becomes longer. As a result, systematically, there is no time loss by increasing the number of times of the aligning operations. Therefore, a good alignment state can be achieved efficiently. Consequently, the number of times of the aligning operations can also be controlled corresponding to the processing time on the upstream side.

The standby position of the movable fence 210 is normally set in a position in which the saddle-stitching position of the bundle of sheets SB faces the stapling position of the saddle-stitching stapler S1. This is because, if the aligning operation is performed in this position, the stapling process can be performed in the stacked position without having to move the movable fence 210 to the saddle-stitching position of the bundle of sheets SB. Consequently, in this standby position, a stitcher of the saddle-stitching stapler S1 is then driven in the direction of arrow b to the central portion of the bundle of sheets SB, and the stapling process is performed between the stitcher and a clincher, thus saddle-stitching the bundle of sheets SB.

The movable fence 210 is positioned by pulse control from the movable fence HP sensor 292, and the trailing end tapping claw 221 is positioned by pulse control from the trailing end tapping claw HP sensor 294. The position control processes of the movable fence 210 and the trailing end tapping claw 221 are executed by a CPU 251 of a control circuit 250 in the second sheet post-processing apparatus 2 (refer to FIG. 15).

Figure 5:
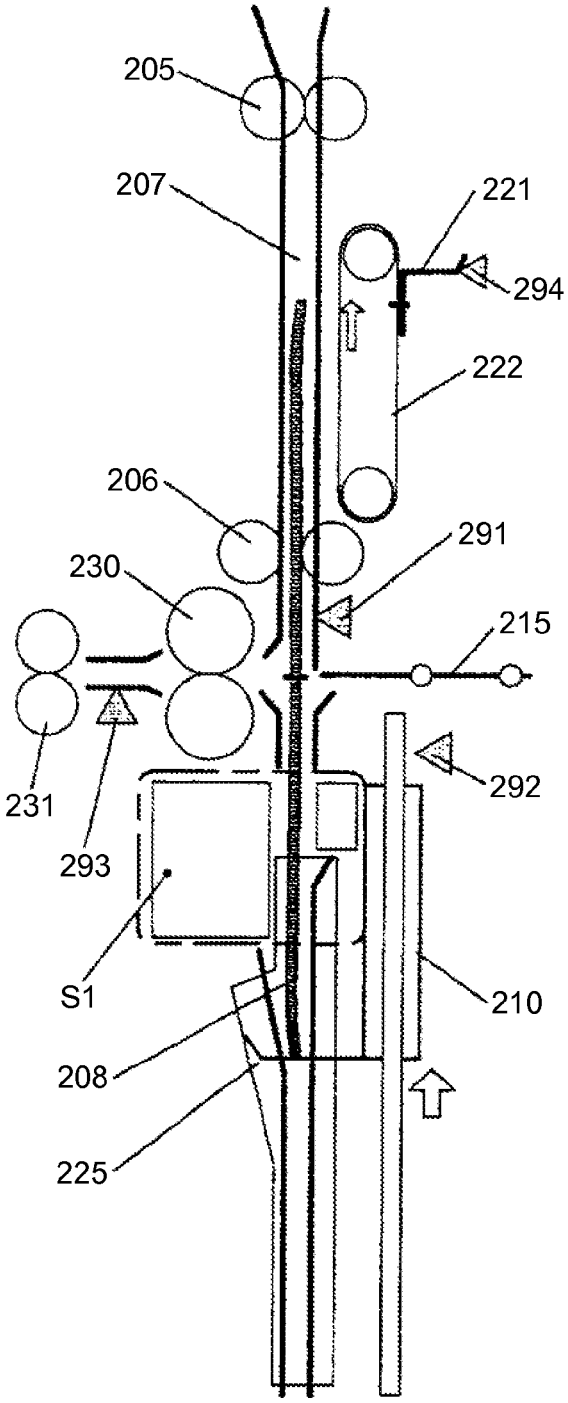
FIG. 5 is an operation explanatory diagram of the saddle-stitching bookbinding apparatus illustrating a state when the bundle of sheets has completed a movement to a middle folding position.

The bundle of sheets SB saddle-stitched in the state illustrated in FIG. 4 is transferred, as illustrated in FIG. 5, along with an upward movement of the movable fence 210 in the state in which the pressure of the lower bundle-conveying rollers 206 is released until the saddle-stitching position (center position of the bundle of sheets SB in the conveying direction) that faces the folding plate 215. This position is also controlled with reference to a detecting position of the movable fence HP sensor 292.

Figure 6:
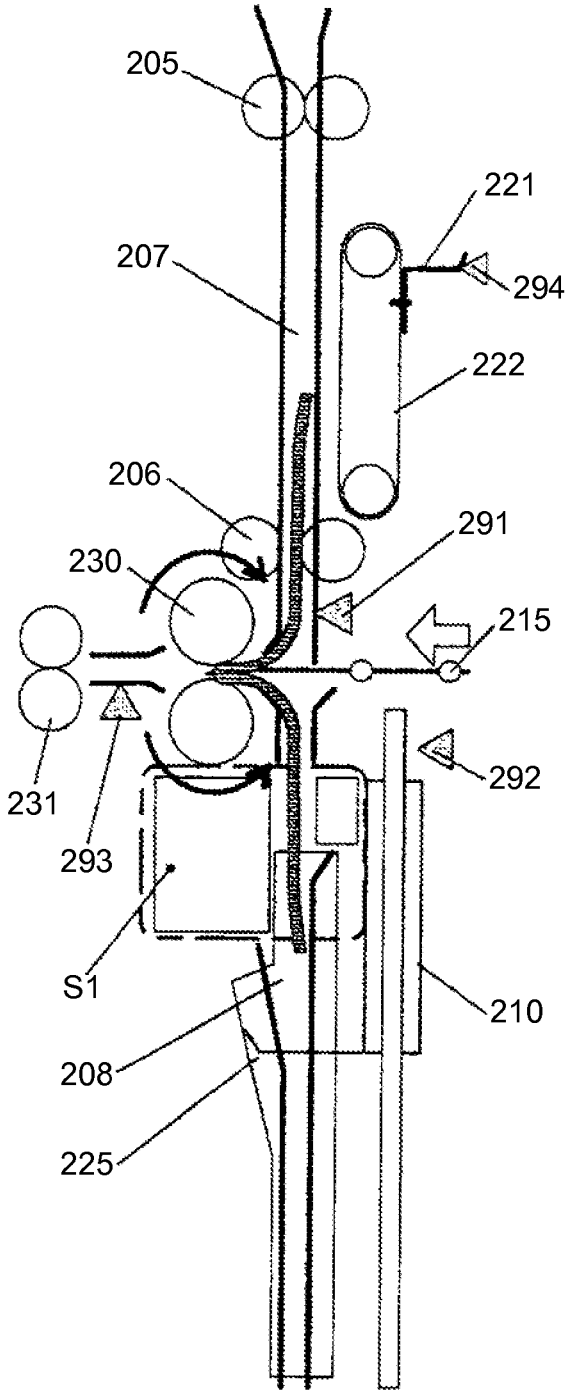
FIG. 6 is an operation explanatory diagram of the saddle-stitching bookbinding apparatus illustrating a state when the bundle of sheets is being middle-folded.

When the bundle of sheets SB reaches the position illustrated in FIG. 5, the folding plate 215 moves toward the nip of the pair of folding rollers 230 as illustrated in FIG. 6, then abuts against the bundle of sheets SB near a staple portion of the stapled bundle of sheets SB from a substantially perpendicular direction, and then pushes the bundle of sheets SB out toward the nip side. The bundle of sheets SB is pushed by the folding plate 215, guided to the nip of the pair of folding rollers 230, and wedged into the nip of the pair of folding rollers 230 that are already rotating. The pair of folding rollers 230 press and convey the bundle of sheets SB wedged into the nip. By this pressure conveying operation, the bundle of sheets SB is folded in the middle, and a simply bound booklet BT is formed. FIG. 6 illustrates a state when the leading end of the folded portion of the bundle of sheets SB is sandwiched and pressed in the nip of the pair of folding rollers 230.

Figure 7:
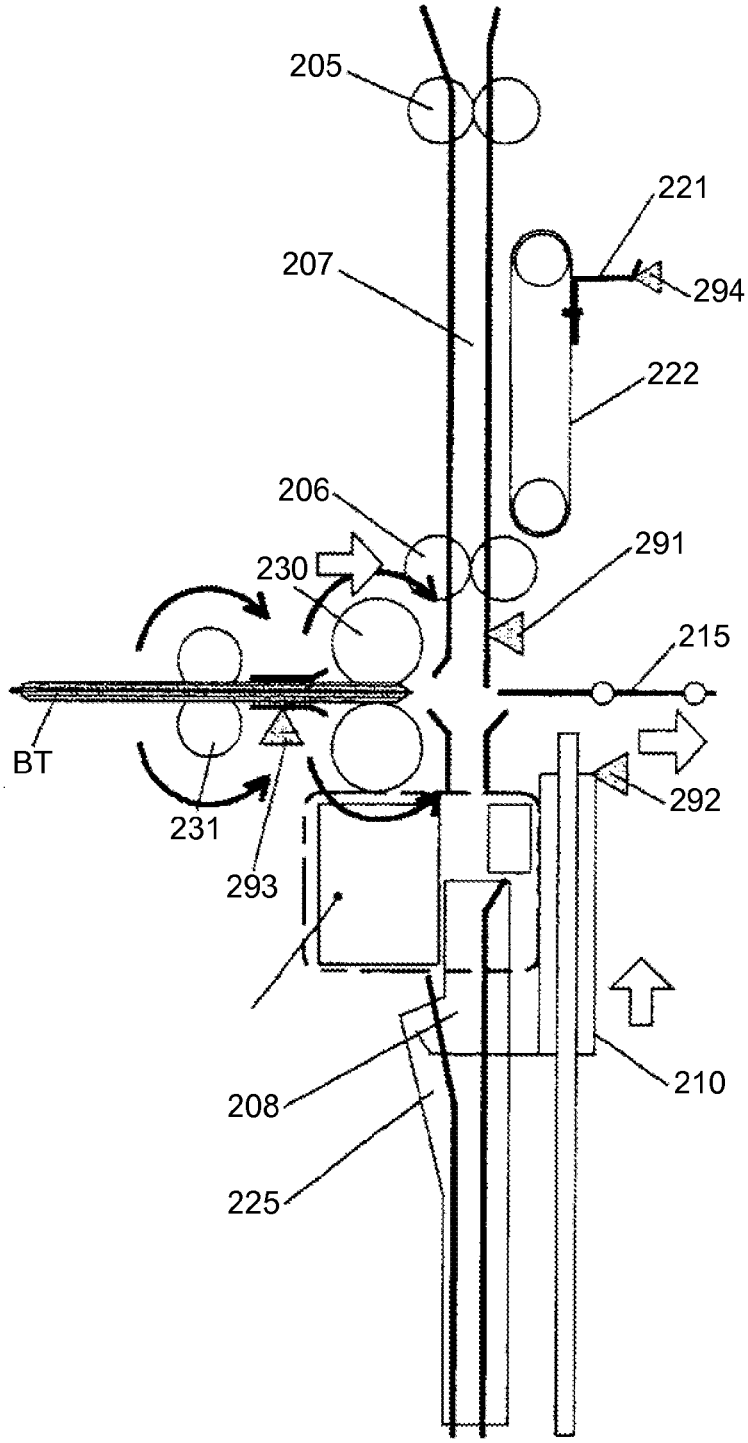
FIG. 7 is an operation explanatory diagram of the saddle-stitching bookbinding apparatus illustrating a state when the bundle of sheets is discharged after having been middle-folded.

The bundle of sheets SB doubled in the middle in the state illustrated in FIG. 6 is conveyed, as illustrated in FIG. 7, as the booklet BT by the pair of folding rollers 230, then sandwiched by the lower discharging rollers 231, and then discharged to the subsequent stage. In this process, when the trailing end of the booklet BT is detected by the folded portion passage sensor 293, the folding plate 215 and the movable fence 210 return to their respective home positions, and the lower bundle-conveying rollers 206 resume the pressing state, thus preparing for the next bundle of sheets SB to be carried in. If the next job is to be performed for the same size and the same number of sheets, the movable fence 210 may move again to the position illustrated in FIG. 3 and stand by. Note that these operations are also controlled by the CPU 251 of the control circuit 250.

Figure 8:
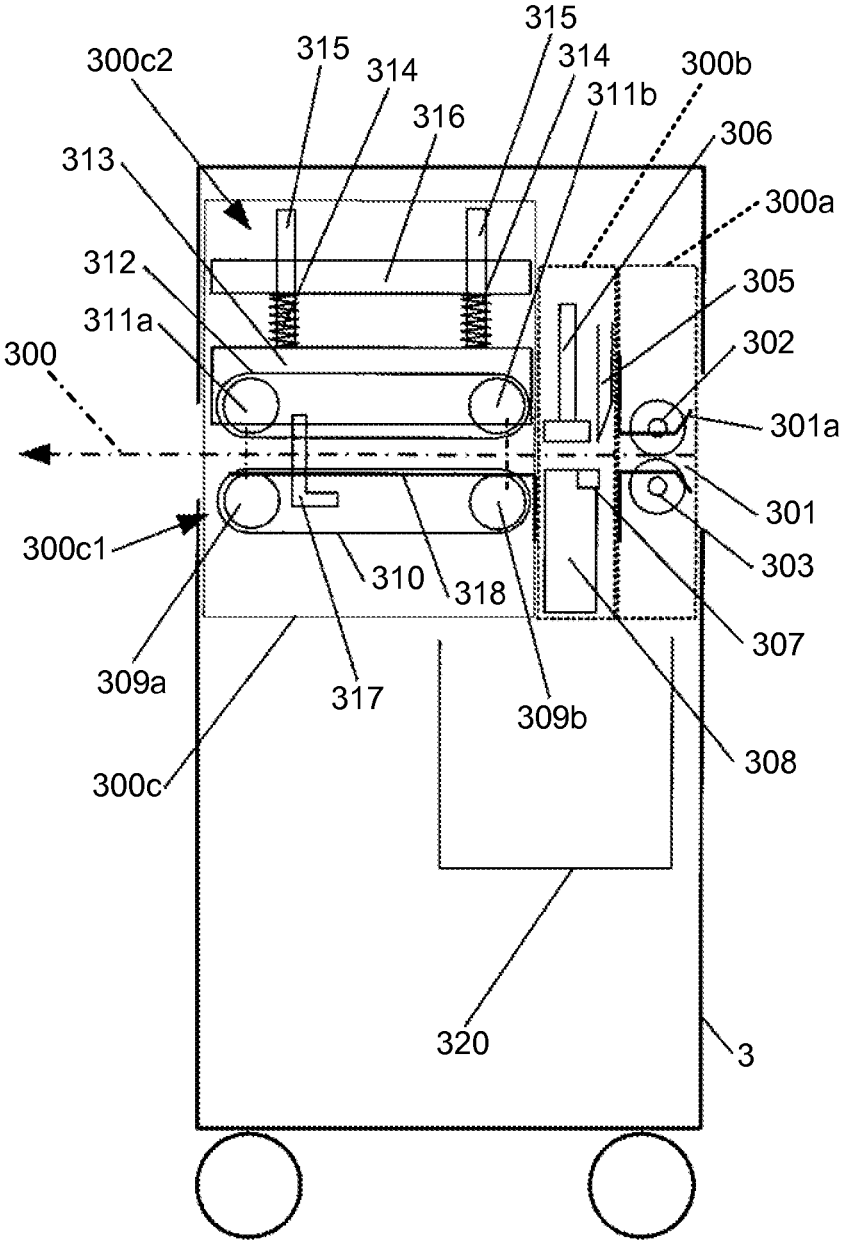
FIG. 8 is a diagram illustrating a detailed structure of a third sheet post-processing apparatus (cutter) in FIG. 1.

FIG. 8 is a diagram illustrating a detailed structure of the cutter 3.

In the diagram, the cutter 3 is provided, from the upstream side along a conveying path 300 of the booklet (arrow indicates the conveying center), with a conveying unit 300*a*, a cutting unit 300*b*, and an aligning unit 300*c*.

Figure 11:
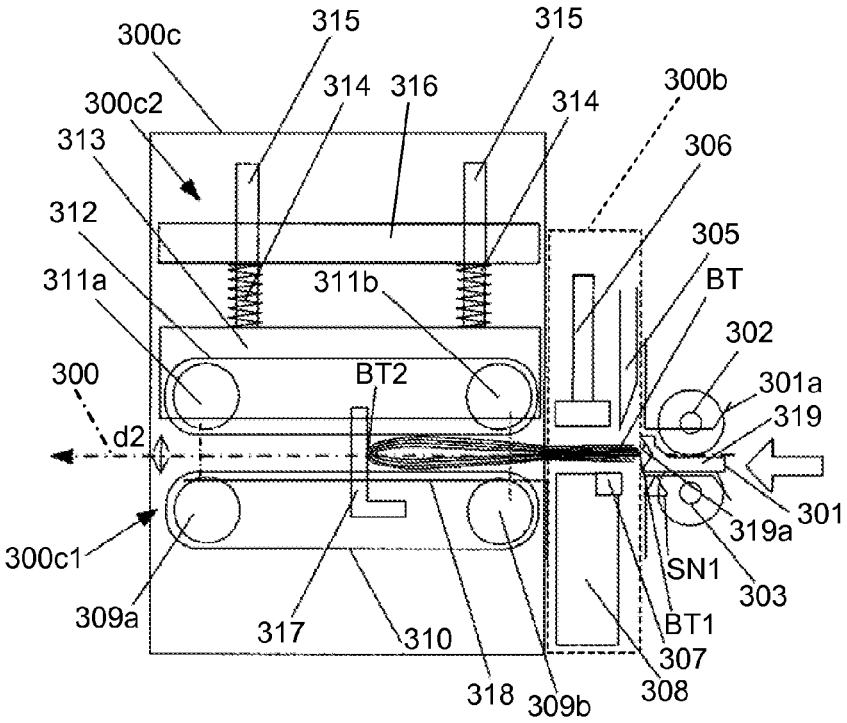
FIG. 11 is an operation explanatory diagram illustrating the cutting operation of the cutter, presented to illustrate a skew correction operation for the booklet.

The conveying unit 300*a* corresponds to an entrance of the cutter 3, and includes an entrance guide plate 301*a*, a pair of upper and lower conveying rollers 302 and 303, and the jogger 319 for pushing to align the booklet BT in the conveying direction (on the end face side) (refer to FIG. 11). The conveying unit 300*a* receives the middle-folded and saddle-stitched booklet BT from the lower discharging rollers 231 of the saddle-stitching bookbinding apparatus 2 through the entrance guide plate 301*a* of a booklet receiving port 301. Note that, instead of the pair of conveying rollers 302 and 303, it is possible to use a pair of conveying belts that are arranged above and below the booklet BT to be capable of sandwiching the booklet at a predetermined pressure and conveying it.

The cutting unit 300*b* includes cutting blades and a pressing unit with the conveying path 300 interposed therebetween. The cutting blades, i.e., an upper cutting blade 305 and a lower cutting blade 307 forming a pair, are arranged above and below the conveying path 300 opposing each other. The upper cutting blade 305 is movable whereas the lower cutting blade 307 is fixed. The upper cutting blade 305 on the movable side moves down toward the booklet BT located above the lower cutting blade 307 on the fixed side, and cuts the end face side of the booklet BT between the two blades. In addition, a scrap receiver 320 for receiving scraps of the cut booklet is provided below the cutting unit 300*b*.

The pressing unit includes a pressing member 306 on the movable side and a base 308 serving as the fixed side, the former being arranged above and the latter being arranged below the conveying path 300, interposing the conveying path 300. The lower cutting blade 307 is fixed to an edge on the uppermost stream side in the conveying direction of the base 308. The fixing position is set in a position in which cutting can be performed by a cutting edge of the upper cutting blade 305 and a cutting edge of the lower cutting blade 307. The upper cutting blade 305 is driven by a drive mechanism (not illustrated) downward to advance to a position beyond the lower cutting blade 307, and driven upward to return to a position in which the upper cutting blade 305 does not obstruct the receiving of the booklet BT. The upper standby position is the initial position.

The pressing member 306 located above the base 308 is driven by a drive mechanism (not illustrated) in the vertical direction, and has a function to hold the booklet BT by pressing it toward the base 308 near the upper cutting blade 305 when the upper cutting blade 305 moves down to cut the booklet BT. The upper cutting blade 305 and the pressing member 306 are driven by the respective drive mechanisms (not illustrated) each using a motor and a speed reduction mechanism connected to the motor. However, the drive mechanisms can be each structured to perform the driving in the vertical direction using hydraulic pressure instead of the motor and the speed reduction mechanism.

The aligning unit 300*c* includes a lower unit 300*c*1 and an upper unit 300*c*2, the lower unit 300*c*1 being located below and the upper unit 300*c*2 being located above the conveying path 300, interposing the conveying path 300. The lower unit 300*c*1 includes a first conveying belt 310 on the fixed side, the positioning stopper 317, and the guide plate 318. The first conveying belt 310 is wound between a driving pulley 309*a* and a driven pulley 309*b*. The upper surface of the first conveying belt 310 is located in the same plane as the upper surface of the base 308, and serves also as a reference plane of conveyance of the booklet BT.

The upper unit 300*c*2 includes a second conveying belt 312, a driving pulley 311*a*, a driven pulley 311*b*, a support member 313, guide shafts 315, a pressing plate 316, and compression springs 314. The second conveying belt 312 is wound between the driving pulley 311*a* and the driven pulley 311*b*. The support member 313 supports the second conveying belt 312, the driving pulley 311*a*, and the driven pulley 311*b* in an integrated manner. The guide shafts 315 are mounted on the upper surface of the support member 313, and equipped with the pressing plate 316 in a vertically movable manner. The guide shafts 315, between the support member 313 and the pressing plate 316, are also equipped with the compression springs 314 that provide elastic forces in a direction in which the support member 313 and the pressing plate 316 move away from each other. The second conveying belt 312, the driving pulley 311*a*, the driven pulley 311*b*, the support member 313, the guide shafts 315, and the pressing plate 316 are vertically movable in an integrated manner as the upper unit 300*c*2. Thus, a distance between the upper surface of the first conveying belt 310 and the lower surface of the second conveying belt 312 can be relatively changed.

With this structure, when the first and the second conveying belts 310 and 312 sandwich the booklet BT, the distance therebetween can be reduced. In this process, a distance between the pressing plate 316 and the support member 313 can also be changed. Therefore, when the pressing plate 316 is moved further down after the second conveying belt 312 presses the upper surface of the booklet BT, the compression springs 314 are further compressed, and thus, a holding force, or a pressing force, to the booklet BT can be increased. A drive mechanism (not illustrated) for driving the upper unit 300*c*2 in the vertical direction includes a motor, a power transmission mechanism, and a guide in the vertical direction that directly move the pressing plate 316 in the vertical direction. When the pressing plate 316 is moved in the vertical direction with the distance between the pressing plate 316 and the support member 313 kept at an initial value, the entire upper unit 300*c*2 moves in the vertical direction. In the state in which the second conveying belt 312 is in contact with the upper surface of the booklet BT, when the pressing plate 316 is moved further downward, the compression springs 314 are compressed, and thus, a pressure by the compression springs 314 is produced by that much. This pressure serves as the holding force, or the pressing force, to the booklet BT. Note that the term "pressing" means to produce a pressure by pushing, and the "pressing force" is a pressure produced by the pressing action, in other words, a pushing force. Note also that a phrase "when something is pressed" means "when the pressing action is performed", that is, "when the object is pushed".

The first conveying belt 310, together with the second conveying belt 312, has a function to convey the booklet BT, and also has a function as a guide during alignment of the sheets. The first and the second conveying belts 310 and 312 have the additional function as a guide during skew correction. Therefore, materials used for surfaces coming in contact with the booklet BT have each a low coefficient of friction against the sheet, and moreover, the coefficients of friction of the two conveying belts 310 and 312 are set to be almost equal to each other. In this manner, when the booklet is pressed, the forces applied to the upper side and the lower side of the booklet are low and almost equal to each other. Consequently, misalignment can be reduced when the booklet is pressed.

In the present embodiment, the first and the second conveying belts 310 and 312 have also a guiding function as guide units. However, it is also possible to provide the guide plate 318 along the first conveying belt 310 on the lower side as illustrated in FIG. 8, to give the guide plate 318 a function as a guide, and to use another conveying unit such as conveying rollers for the function to convey the booklet BT. In that case, the upper surface of the guide plate 318 is located in the same plane as the upper surface of the base 308, and serves also as the reference plane of conveyance of the booklet BT. It is also possible to structure the second conveying belt 312 on the upper side so as to press the booklet BT to the guide plate 318 side.

In addition, in the present embodiment, the first conveying belt 310 on the lower side is fixed, and the second conveying belt 312 on the upper side performs the up and down operations. However, it is also possible to structure the second conveying belt 312 on the upper side so as to serve as a fixed side and the first conveying belt 310 on the lower side so as to serve as a moving side, or to structure both of the first and the second conveying belts 310 and 312 so as to move.

Furthermore, the positioning stopper 317 installed in the aligning unit 300*c* includes a moving mechanism (not illustrated) that can move the stopper in the booklet conveying direction. Based on the information such as the size and the cutting amount of the booklet BT, the moving mechanism moves the stopper to a predetermined position, whereby the spine side of the booklet BT abuts against the stopper and thus positioned. The moving mechanism includes a motor and a transmission mechanism of the driving force of the motor.

Figure 13:
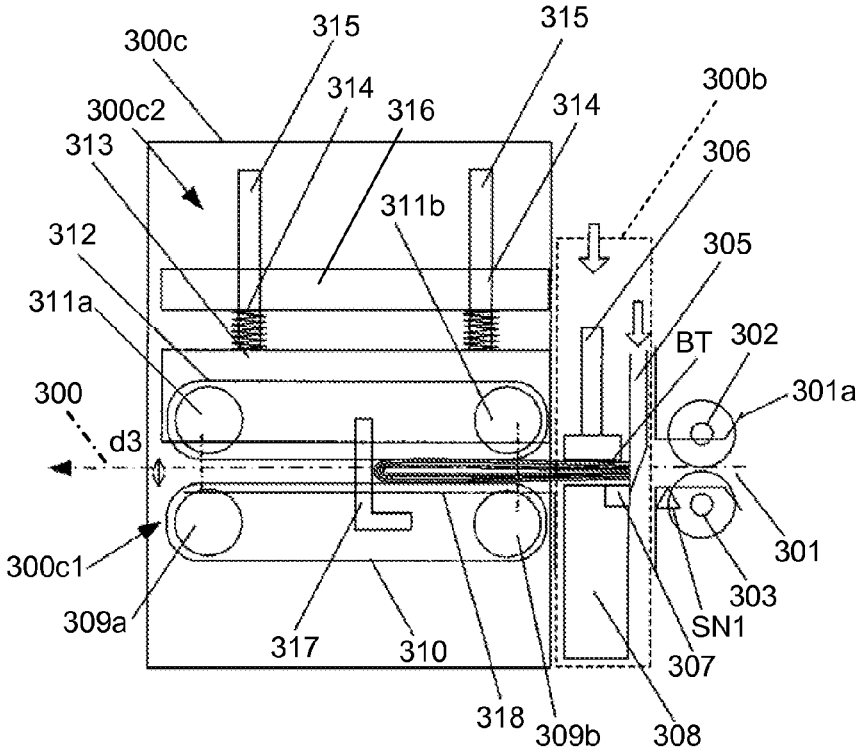
FIG. 13 is an operation explanatory diagram illustrating the cutting operation of the cutter, presented to illustrate an operation when the booklet is cut after being subjected to the skew correction.
Figure 14:
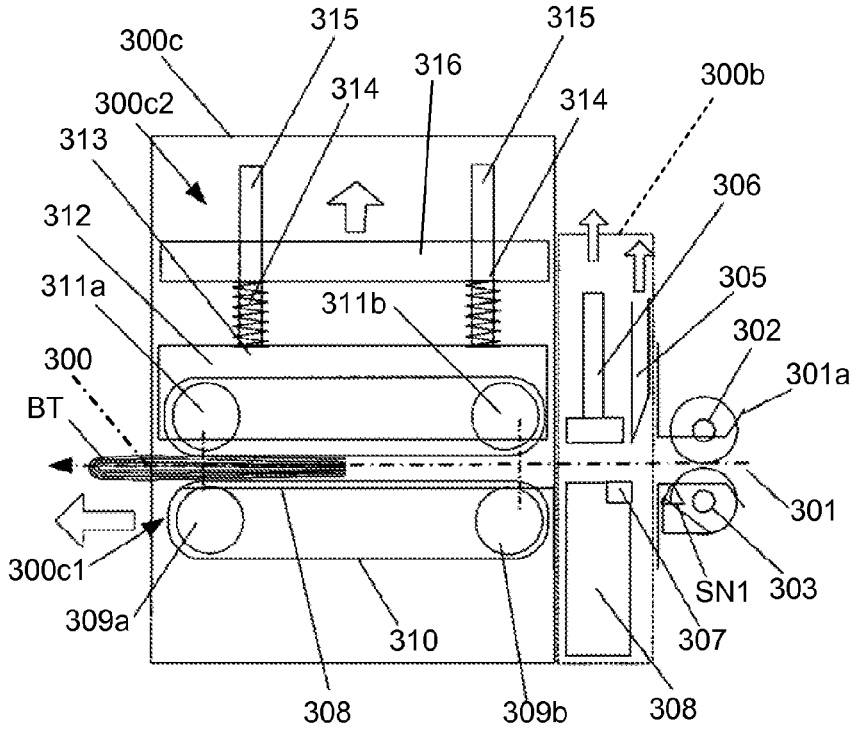
FIG. 14 is an operation explanatory diagram illustrating the cutting operation of the cutter, presented to illustrate an operation after the cutting is finished.
Figure 15:
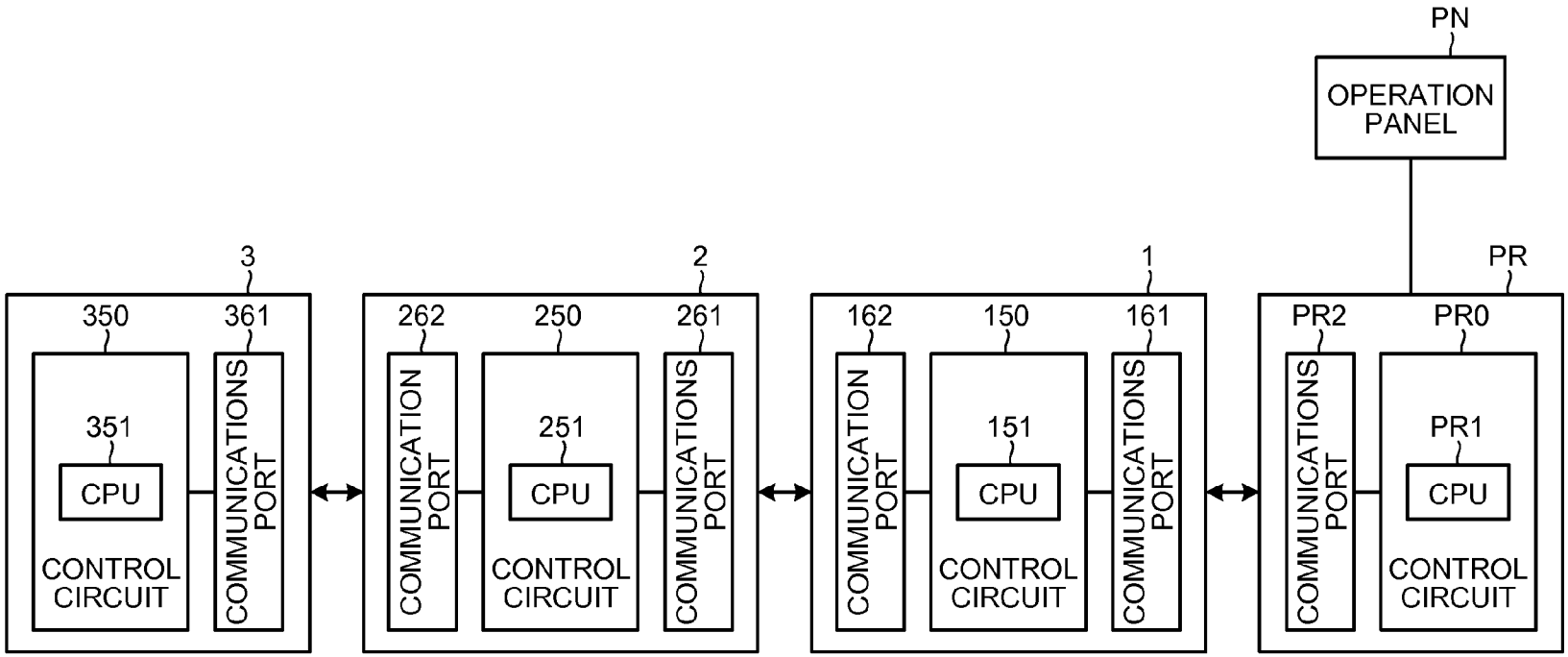
FIG. 15 is a block diagram illustrating a control structure of the image forming system in the embodiment of the present invention.

FIGS. 9 to 14 are operation explanatory diagrams each illustrating a cutting operation of the cutter 3 in the present embodiment, and FIG. 15 is a block diagram illustrating a control structure of the image forming system in the present embodiment.

In the image forming system according to the present embodiment illustrated in FIG. 15, the first sheet post-processing apparatus 1, the second sheet post-processing apparatus (saddle-stitching bookbinding apparatus) 2, and the third sheet post-processing apparatus (cutter) 3 are connected in the subsequent stages of the image forming apparatus PR as illustrated in FIG. 1. The image forming apparatus PR and the sheet post-processing apparatuses 1, 2, and 3 are equipped with control circuits PR0, 150, 250, and 350, respectively, that incorporate microcomputers having components such as CPUs (central processing units) PR1, 151, 251, and 351, respectively, ROMs (read-only memories), RAMs (random access memories), and I/O interfaces, and are connected in series in terms of control via communication ports PR2, 161, 162, 261, 262, and 361. Moreover, the CPUs 151, 251, and 351 of the control circuits 150, 250, and 350 in the first to the third sheet post-processing apparatuses 1, 2, and 3 are placed under the control of the CPU PR1 as a main CPU of the control circuit PR0 in the image forming apparatus PR, and serve as sub CPUs. In addition, an operation panel PN serving as a man-machine interface is connected to the image forming apparatus PR, thereby enabling input from an operator and notification to the operator via a display unit.

That is, each part of each of the sheet post-processing apparatuses 1, 2, and 3 is controlled by each of the CPUs 151, 251, and 351 mounted in each of the apparatuses, and the CPU PR1 of the image forming apparatus PR controls the entire system. The apparatuses perform control as follows: The CPUs 151, 251, and 351 of the respective apparatuses read program codes stored in the ROM of each of the apparatuses, and perform control based on a computer program defined by the program codes while using the RAM as a work area and a data buffer. The CPU 151 of the first sheet post-processing apparatus 1 can mutually communicate with the CPU PR1 of the image forming apparatus PR from the communication port 161 via the communication port PR2 of the image forming apparatus PR. In addition, the CPUs 251 and 351 of the second and the third sheet post-processing apparatuses 2 and 3 can mutually communicate with the CPU PR1 of the image forming apparatus PR via the communication ports and the CPUs in the previous stages. With such a structure, information required for control by the CPU PR1 of the image forming apparatus PR is sent from the CPUs 351, 251, and 151 of the third sheet post-processing apparatus 3, the second sheet post-processing apparatus 2, and the first sheet post-processing apparatus 1 to the image forming apparatus PR side, and control signals from the CPU PR1 of the image forming apparatus PR are sent to the CPU 151, the CPU 251, and the CPU 351.

With reference to the operation explanatory diagrams of FIGS. 9 to 14, description will be made below of operations and processes during the operations in the cutter 3.

Figure 9:
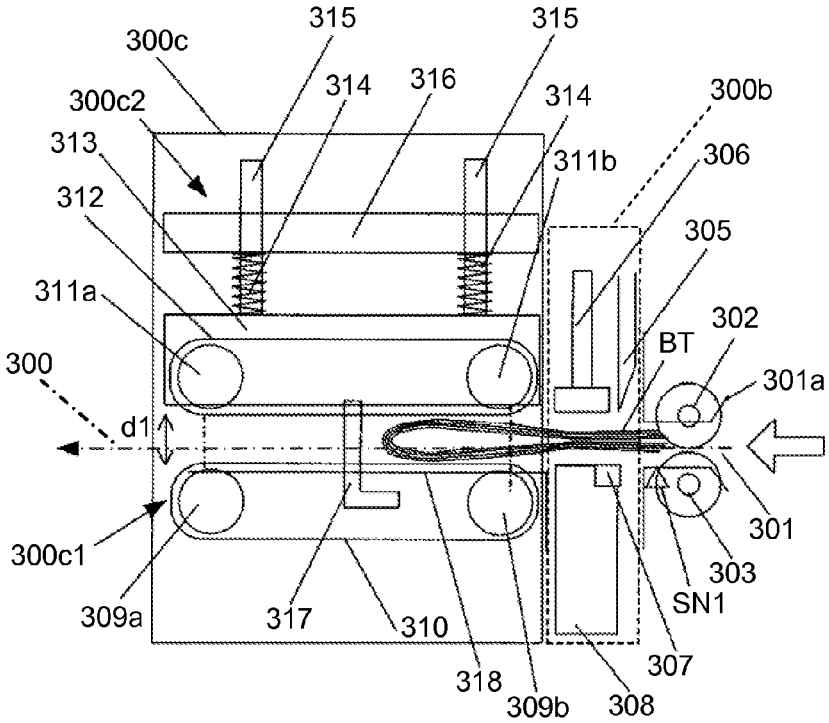
FIG. 9 is an operation explanatory diagram illustrating a cutting operation of the cutter, presented to illustrate a state immediately after the booklet is carried into the cutter.

FIG. 9 is a diagram illustrating a state immediately after the booklet BT is carried into the cutter 3. In the diagram, the booklet BT is carried into the cutter 3 through the entrance guide plate 301*a*. In that process, when a detection signal of the booklet leading end is detected by an entrance sensor SN1 provided on the immediately downstream side of the booklet receiving port 301, or a detection signal of the folded portion leading end of the bundle of sheets SB is detected by the folded portion passage sensor 293 of the saddle-stitching apparatus bookbinding 2, each part of the cutter 3 starts a booklet receiving preparatory operation. The booklet receiving preparatory operation is an operation of moving down the upper unit 300*c*2 from an initial position thereof. By the booklet receiving preparatory operation, the upper unit 300*c*2 moves to a position in which the distance between the lower surface of the second conveying belt 312 and the upper surface of the first conveying belt 310 is a first distance d1 when the sheets are carried in. As will be described later, the CPU 351 determines the first distance d1 by referring to a database stored in a memory (not illustrated) in the control circuit 350 of the cutter 3 based on the booklet information such as the sheet thickness, the sheet size, the number of bound sheets, and special paper. The distance d1 is a distance that can provide a frictional force by which the first and the second conveying belts 310 and 312 can convey the booklet BT after being carried into the cutter 3 by the pair of conveying rollers 302 and 303. That is, the distance d1 is sufficient to be a distance at which the booklet BT can be conveyed.

The positioning stopper 317 moves to a position in which the sheets are positioned based on the information such as the size and the cutting amount of the booklet. When the movement is completed, the pair of conveying rollers 302 and 303 and the first and the second conveying belts 310 and 312 start rotating and start receiving the booklet BT. In order to match the phases between the first and the second conveying belts 310 and 312, the drives of driving pulleys 309*a* and 311*a* are coupled. In the state as described above, at the time when a predetermined time has passed from the time when the entrance sensor SN1 has detected the leading end of the spine (folded portion) of the booklet BT carried into the cutter 3, the first and the second conveying belts 310 and 312 stop rotating, and the leading end (leading end of folded portion or spine) of the booklet BT stops at a predetermined distance short of the positioning stopper 317.

Figure 10:
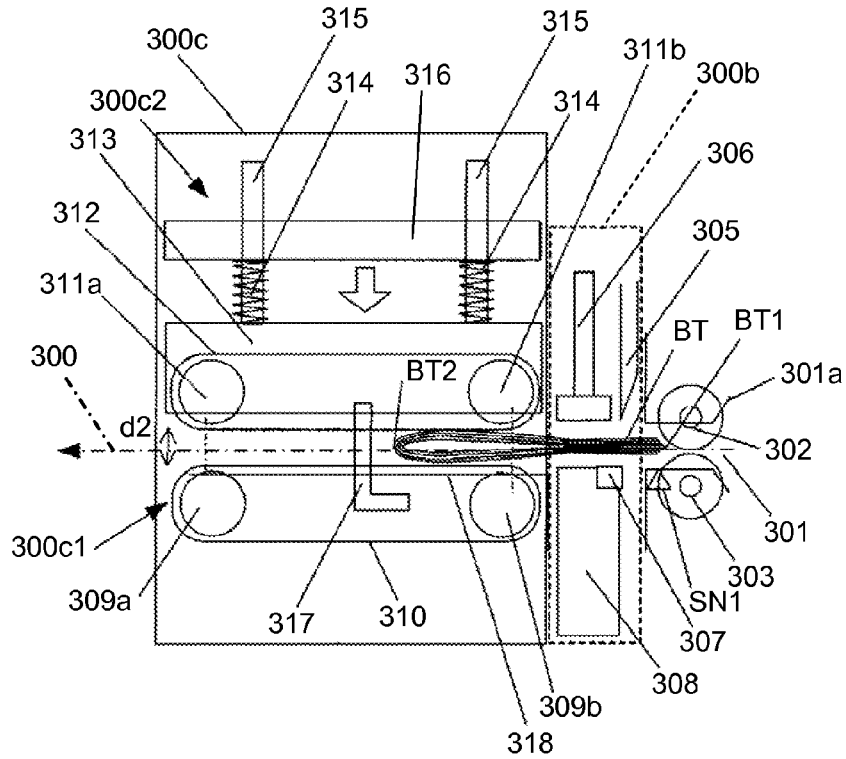

FIG. 10 is an operation explanatory diagram illustrating an operation of pressing the stopped booklet down to a certain thickness. After the booklet BT has stopped in the state of FIG. 9, the upper unit 300*c*2 moves down to a position in which the distance between the upper surface of the first conveying belt 310 and the lower surface of the second conveying belt 312 is a second distance d2. By this operation, the bulky and thick booklet BT is pressed down to a certain height. In the same manner as the first distance d1, the second distance d2 is also determined as an aligning distance corresponding to the booklet information such as the sheet thickness, the sheet size, the number of bound sheets, and special paper. In this state, no change has occurred except that the position of the support member 313 has been changed to an aligning position.

FIG. 11 is an operation explanatory diagram illustrating an operation to align the conveying direction of the booklet and correct the skew thereof. In the state of FIG. 10, the booklet BT is pushed into an interval having the second distance d2, and then, while maintaining the distance at the second distance d2, the trailing end jogger 319 is driven. The trailing end jogger 319 pushes the end face side (trailing end BT1) of the booklet BT toward the positioning stopper 317, and abuts the spine side (leading end BT2 in the conveying direction) of the booklet BT against the positioning stopper 317. In this manner, the booklet BT is positioned in the conveying direction. Therefore, the distance d2 is a distance at which the booklet BT can be pressed and moved toward the positioning stopper 317 by the trailing end jogger 319 without the booklet BT being subjected to warp or distortion, that is, a distance enabling a reduction of height of the sheets and the alignment processing.

As a method for abutting the booklet BT against the positioning stopper 317, it is also possible to employ a method in which the booklet BT is moved by the first and the second conveying belts 310 and 312. However, if a conveying force of the first and the second conveying belts 310 and 312 is large, turning up of a surface sheet of the booklet BT can occur. In that case, the conveying force needs to be set so that the first and the second conveying belts 310 and 312 do not cause any turning up in the booklet BT. In the present embodiment, the trailing end jogger 319 is used in order to avoid such turning up phenomenon from occurring.

Figure 12:
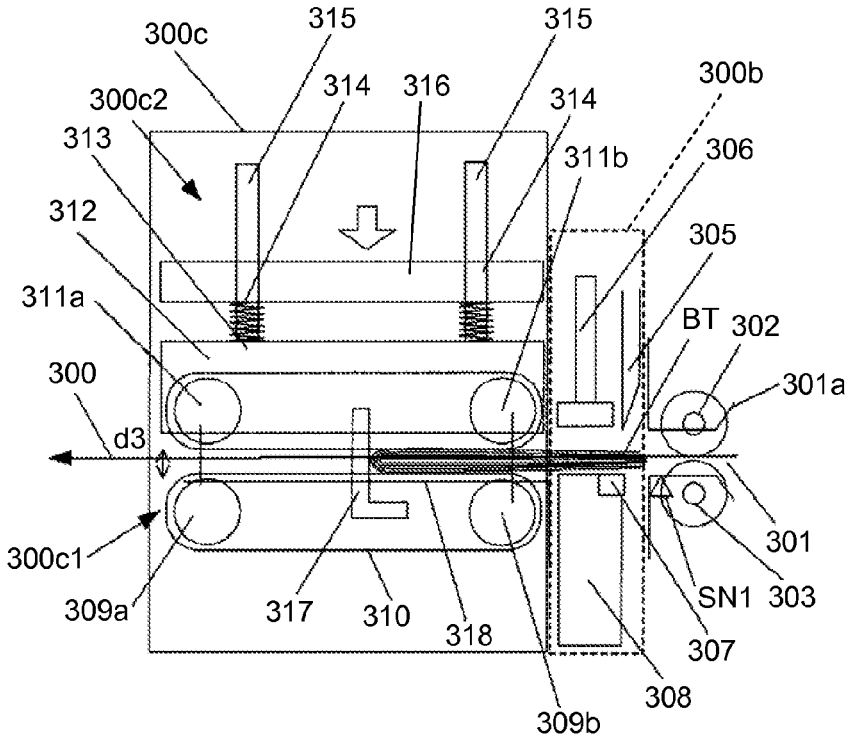
FIG. 12 is an operation explanatory diagram illustrating the cutting operation of the cutter, presented to illustrate an operation when the booklet is pressed and fixed.

FIG. 12 is an operation explanatory diagram illustrating an operation when the booklet is pressed and fixed. When the booklet BT has been positioned by the trailing end jogger 319 between the positioning stopper 317 and the trailing end jogger 319, the upper unit 300*c*2 is further moved down to a position at a third distance d3. By this operation, the booklet BT is pressed toward the lower unit 300*c*1 and fixed between the first and the second conveying belts 310 and 312.

In that operation, after the first conveying belt 310 has abutted against the upper surface of the booklet BT, the pressing plate 316 is further moved down. In this manner, the elastic forces of the compression springs 314 are applied as a pressure to the booklet BT while the booklet BT is held at a minimum thickness. Accordingly, the pressure applied to the booklet BT can be controlled by changing or setting the amount of downward movement of the pressing plate 316. The amount of downward movement of the upper unit 300*c*2 (gap distance between the first and the second conveying belts 310 and 312) and the amount of downward movement of the pressing plate 316 are determined corresponding to the booklet information such as the sheet thickness, the sheet size, the number of bound sheets, and the paper type (such as special paper). The distance d3 is a distance sufficient to press the booklet BT down to the minimum thickness and complete it to a final thickness while each sheet of the booklet BT is stretched, that is, a distance enabling to press and fix the booklet BT.

FIG. 13 is an operation explanatory diagram illustrating an operation when the booklet is cut after being aligned. After the booklet BT is aligned in the position thereof and pressed to be fixed as illustrated in FIG. 12, the pressing member 306 provided near the upper cutting blade 305 is moved down to press the booklet BT near a cutting position thereof to the upper surface of the base 308 and the upper cutting blade 305 is moved down so as to cut the end of the booklet BT between the upper cutting blade 305 and the lower cutting blade 307. Booklet scrap pieces cut from the end face side are contained in the scrap receiver 320. The amount of downward movement of the pressing plate 316 is an amount that allows the compression springs 314 to apply a sufficient pressing force to hold and fix each sheet, particularly the surface sheet, of the booklet BT so as not to be misaligned when the pressing plate 316 moves down and presses the end face side of the booklet BT onto the upper surface of the base 308.

FIG. 14 is an operation explanatory diagram illustrating an operation after the cutting is finished. After the cutting illustrated in FIG. 13 is performed, the upper cutting blade 305 and the pressing member 306 are retracted from the cutting positions to the initial positions above. Then, the pressing plate 316 and the upper unit 300*c*2 move up, and the pressure applied to the booklet BT is released until reaching a pressure allowing the booklet to be conveyed. The upward movement distance at this time is determined corresponding to the booklet information such as the sheet thickness, the sheet size, the number of bound sheets, and the paper quality (such as special paper). Thereafter, the first and the second conveying belts 310 and 312 are rotated in the conveying direction, and thus, the booklet BT cut at the end thereof is discharged out of the cutter 3. Then, at the time when the discharge is completed, a sequence of operations in the cutter 3 is completed.

The database that is referred to with respect to the first to the third distances d1, d2, and d3, and with respect to the amount of downward movement of the pressing plate 316 is formed as follows: by using an actual apparatus before shipment, the optimal values for the distances d1, d2, and d3 and the amount of downward movement are obtained in advance with respect to combinations of elements such as the sheet thickness, the sheet size, the number of bound sheets, and the paper type (such as special paper) of booklets BT that can be subjected to the cutting process in the cutter 3, and the obtained values are formed into the database. For example, when the CPU PR1 of the image forming apparatus PR sends to the CPU 351 of the cutter 3 the booklet information that the sheet thickness is normal thickness (thickness of normal paper when divided into thin paper, normal paper, and thick paper; represented by e.g., metric basis weight in $g/m^2$), the sheet size is A3, the number of bound sheets is 10, the paper type is plain paper, the CPU 351 refers to the database in the memory to obtain the first to the third distances d1, d2, and d3 and the amount of downward movement of the pressing plate 316 corresponding to the booklet information, and determines the first to the third distances d1, d2, and d3 and the amount of downward movement of the pressing plate 316. This operation allows the cutting process to be performed in the state of holding the booklet BT with an optimal holding force or pressing force.

By holding the booklet BT in this manner, the booklet BT is suppressed from being deflected, and, when pressed by the pressing member, prevented from being misaligned, and thus, accurate sheet processing can be performed.

Figure 16:
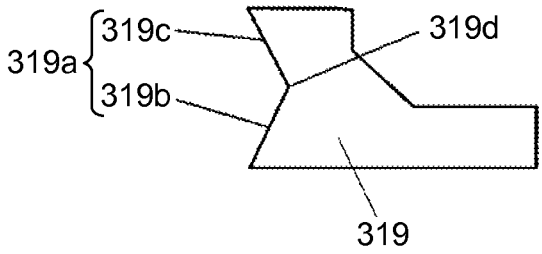
FIG. 16 is a front view illustrating a jogger in the embodiment of the present invention in an enlarged manner.

FIG. 16 is a front view illustrating the jogger 319 in the embodiment of the present invention in an enlarged manner. The jogger 319 in the present embodiment has a pressing surface 319*a* that serves as a surface abutting against the end face side of the booklet BT and pushing the end. The pressing surface 319*a* is formed to have a V-shaped cross section recessed in the middle. More specifically, the pressing surface 319*a* is formed as a plane that is composed of a first inclined surface 319*b* on the lower side that is formed as an inclined surface (upward slant surface) rising rightward in the drawing and a second inclined surface 319*c* on the upper side that is formed as an inclined surface (downward slant surface) falling rightward in the drawing, and that extends in a direction perpendicular to the booklet conveying direction. Assuming that an intersection of the first inclined surface 319*b* and the second inclined surface 319*c* is denoted by a reference numeral 319*d*, the intersection 319*d* is present as a line (switching portion between planes) extending in the direction perpendicular to the booklet conveying direction.

Figure 17:
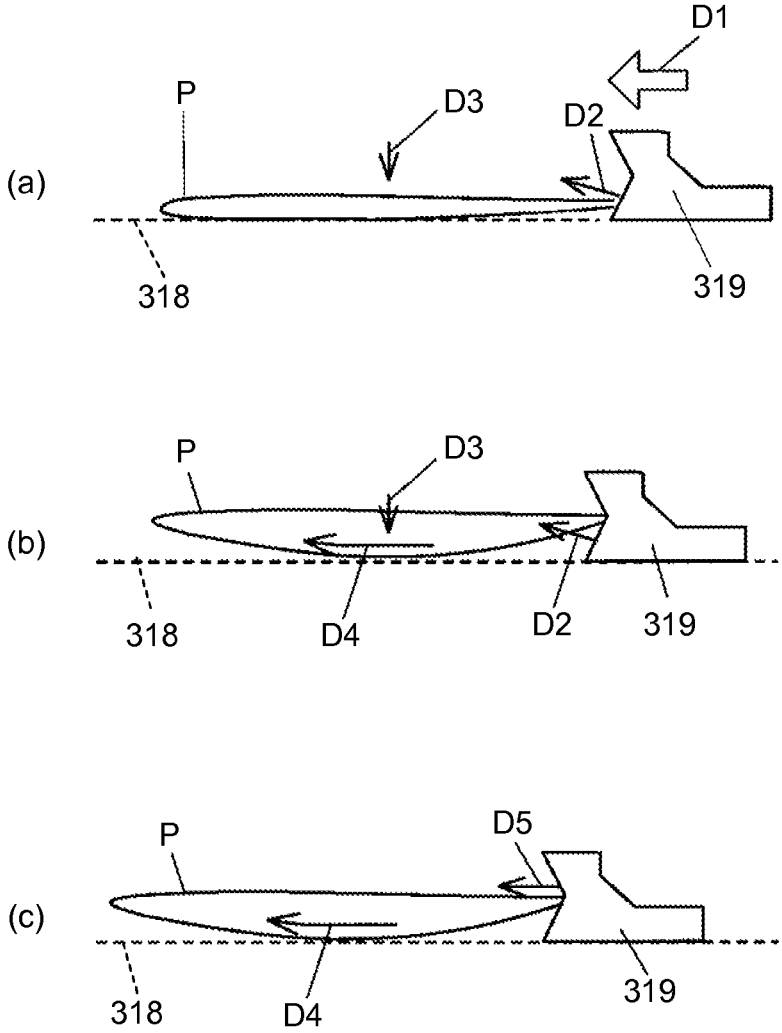
FIG. 17 illustrates an operation of the jogger illustrated in FIG. 16 and states of a sheet.

FIG. 17 illustrates an operation of the jogger 319 illustrated in FIG. 16 and the states of a sheet. Note that, in these diagrams, description will be made regarding a single sheet P instead of the booklet BT.

In (a) of FIG. 17, the jogger 319 advances in the direction of arrow D1 from the trailing end side of the sheet P that has been conveyed and stopped in a predetermined position, and abuts against the trailing end of the sheet P. The trailing end of the sheet P is pushed by the first inclined surface 319*b* of the jogger 319, and a force acts in a direction parallel to the guide plate 318. This force is divided into a component force in a direction (direction of arrow D2) perpendicular to the first inclined surface 319*b* and a component force in a direction along the inclined surface. Due to a reaction to the component force in the direction along the inclined surface, a force acts downward (in the direction of arrow D3) near the center of the sheet P. The sheet P is deflected downward by this force, and as illustrated in (b) of FIG. 17, the deflection of the sheet P is suppressed by the guide plate 318, generating a force in the horizontal direction (direction of arrow D4) due to a high stiffness of the sheet P, and thus, moving the sheet P in the direction of arrow D4 without buckling.

When the trailing end of the sheet P is scooped up toward the most recessed portion of the first and the second inclined surfaces 319*b* and 319*c* of the jogger 319, the trailing end of the sheet P moves to the intersection 319*d* in a sliding manner, and the jogger 319 results in pushing the sheet P in the horizontal direction (direction of arrow D5). That is, neither the component force in the direction perpendicular to the inclined surface nor the component force in the direction along the inclined surface is generated. However, the sheet P smoothly moves in the horizontal direction without buckling because the downward deflection has been generated in the sheet P before.

The above-described operation also applies to the booklet BT. Also in the case of the booklet BT, the booklet BT is deflected downward, and thus, is curved so as to be convex downward, consequently increasing the stiffness of the sheet in contact with the guide plate 318 on the lower side. Through this effect, the booklet BT does not buckle when the jogger 319 pushes the end of the booklet BT and moves the booklet BT. As a result, the positioning and the skew correction can be performed in a reliable manner.

Figure 18:
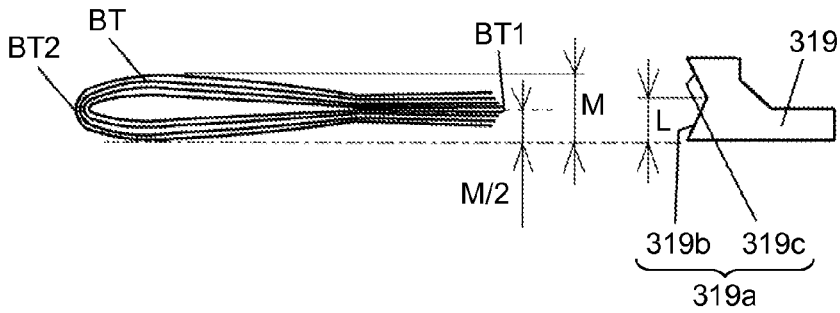
FIG. 18 is a diagram illustrating a relationship between the booklet and a pressing surface of the jogger.

FIG. 18 is a diagram illustrating a relationship between the booklet BT and the pressing surface 319*a* of the jogger 319. In the present embodiment, a height L of the intersection 319*d* corresponding to the most recessed portion of the pressing surface 319*a* of the jogger 319 measured from the guide plate 318 on the lower side is set to be greater than half a maximum booklet thickness M (M/2) processable by the cutter 3. That is, the height L is set relative to the maximum processable booklet thickness M as follows:

$$L > M/2 \quad (1)$$

Figure 19:
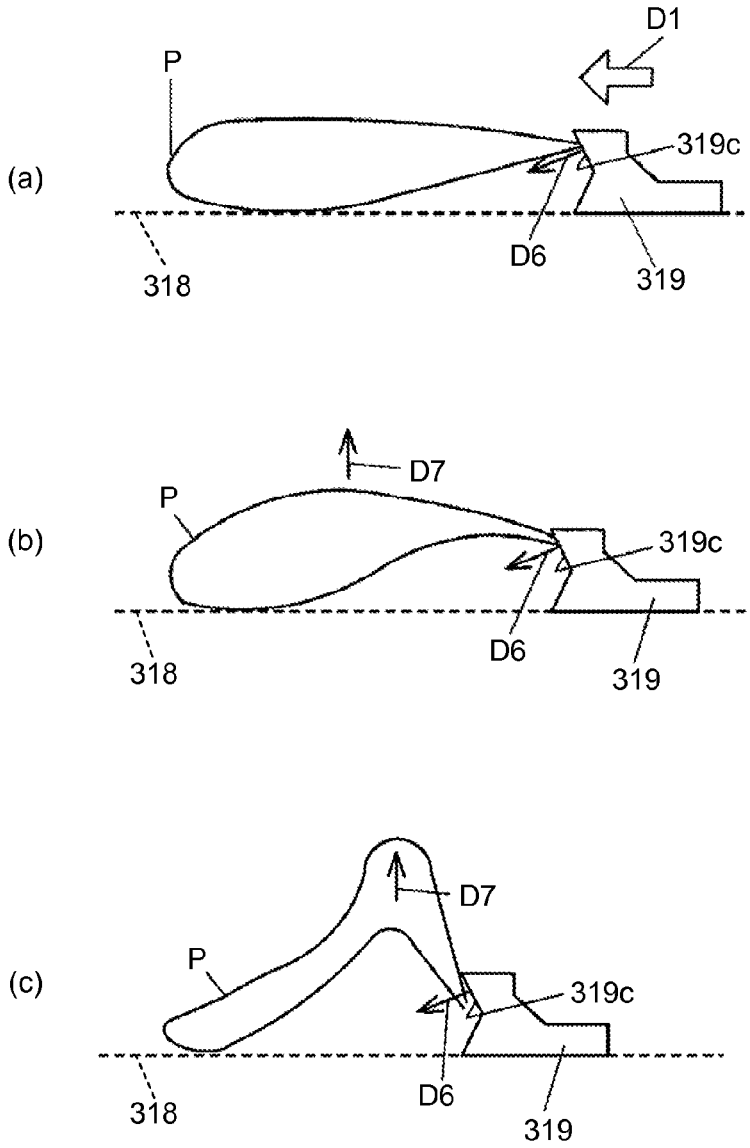
FIG. 19 illustrates a trouble occurring when a condition of the pressing surface is not met.
Figure 20:
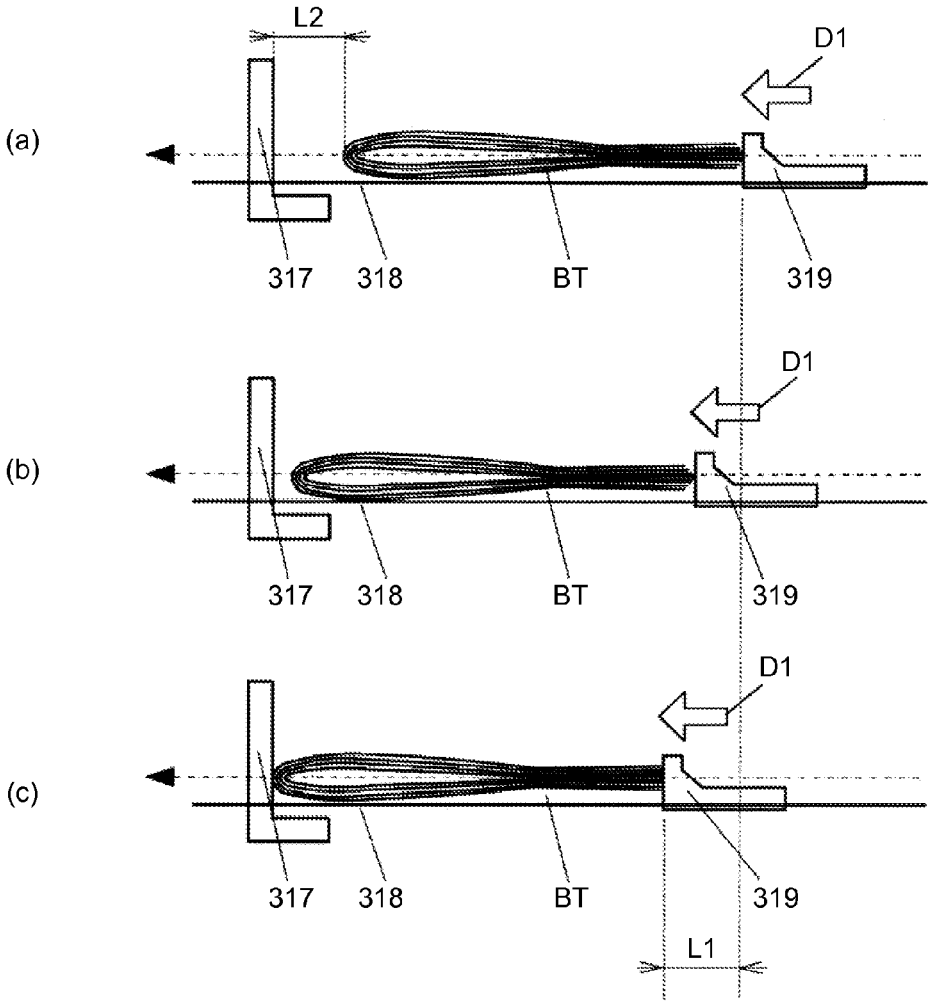
FIG. 20 illustrates a state of a conventional general skew correction, presented to illustrate a state in which the skew correction is properly performed.
Figure 21:
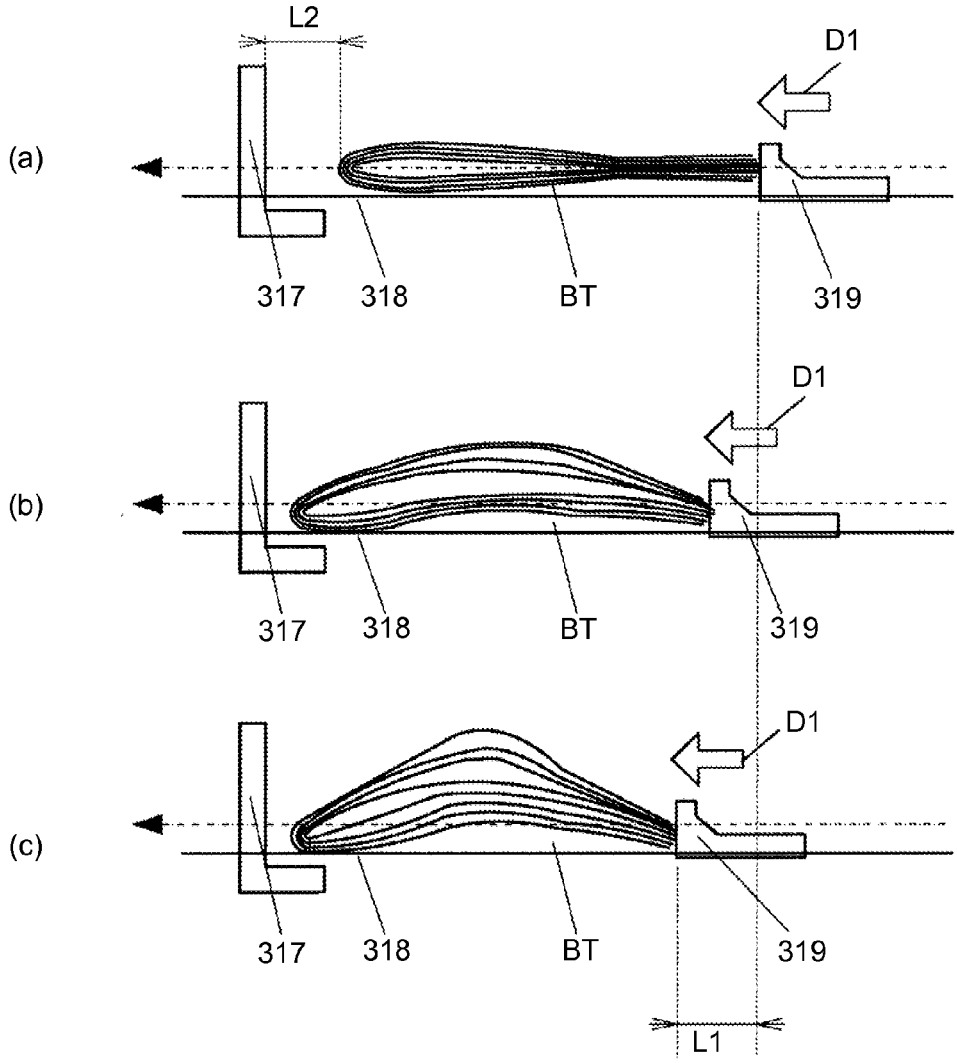
FIG. 21 illustrates a state of the conventional general skew correction, presented to illustrate an example in which the skew correction is not properly performed.

This is because a problem occurs as illustrated in FIG. 19 if the height L is set so that $L \leq M/2$. FIG. 19 illustrates an operation of the jogger and the states of a sheet in the case that $L \leq M/2$. Also in this case, description will be made regarding the single sheet P as a substitute for the booklet BT.

Illustrated in (a) of FIG. 19 is a state in which the pressing surface 319*a* of the jogger 319 abuts against the trailing end of the sheet P that has been conveyed and stopped in the predetermined position, and pushes the sheet P in the direction of arrow D1. In this state, the trailing end of the sheet P is pushed by the second inclined surface 319*c*, and component forces are generated in a direction (direction of arrow D6) perpendicular to the second inclined surface 319*c* and in a direction along the inclined surface. Thus, due to a reaction to the component force in the direction along the inclined surface, a force acts upward (in the direction of arrow D7) near the center of the sheet P as illustrated in (b) of FIG. 19. This force in the direction of arrow D7 in turn generates a deflection of the sheet P.

When the jogger further moves in the direction of arrow D1 in this state, a further force acts in the direction of arrow D7, and thus, the force acts in the direction of increasing the deflection. As a result, buckling occurs as illustrated in (c) of FIG. 19. When the buckling has occurred, the movement of the jogger 319 only increases the amount of deformation of the sheet P in the direction of arrow D7, while the sheet P becomes immovable in the direction of arrow D1 along the guide plate 318. Consequently, the leading end of the sheet P does not abut against the positioning stopper 317, and thus, the positioning and the skew correction cannot be performed.

On the other hand, if the height L of the intersection 319*d* and the maximum processable booklet thickness M are set as given by Inequality (1) defined above, the trailing end BT1 corresponding to the most trailing end of the booklet BT abuts against the first inclined surface (upward slant surface) 319*b* or the intersection 319*d* as illustrated in FIG. 18. In this manner, as has been described with reference to FIG. 17, the downward force (in the direction of arrow D3) acts on the booklet BT, and the booklet BT is prevented from buckling and can be moved in a reliable manner by the jogger 319 along the surface of the guide plate 318 to a position to abut against the positioning stopper 317.

As described above, according to the present embodiment, the following effects are produced.

1) When the jogger 319 pushes the trailing end BT1 in the conveying direction of the booklet BT so as to cause the leading end BT2 of the booklet BT to abut against the positioning stopper 317 during alignment of the booklet BT formed by folding the bundle of sheets SB on the conveying path 300, the force acting while the trailing end BT1 is pushed, deflects the booklet BT downward. Accordingly, the deflection is controlled by the guide plate 318 that guides the booklet BT, preventing buckling. In this manner, the moving amount of the booklet BT is ensured, and the booklet BT is pushed in a reliable manner by the jogger 319 toward the positioning stopper 317, thus enabling to press the leading end BT2 of the booklet BT against the positioning stopper 317. As a result, the skew of the booklet can be corrected in a reliable manner. In addition, the skew correction requires no other members or devices such as a controlling plate because the booklet BT is deflected toward the guide plate 318 (downward) when being pushed by the jogger 319.

2) In order to generate the deflection in the downward direction of the booklet, the pressing surface 319*a* of the jogger 319 is composed of the two inclined surfaces 319*b* and 319*c* such that the cross section of the pressing surface 319*a* has a recessed shape with respect to the trailing end BT1 of the booklet BT. This simple structure enables the booklet BT to be deflected downward.

3) The pressing surface 319*a* is formed to be a recessed surface composed of the first inclined surface 319*b* that has the upward inclination where the upstream side in the conveying direction is located above the downstream side, and the second inclined surface 319*c* that has the downward inclination where the upstream side in the conveying direction is located below the downstream side. In addition, the height L of the intersection 319*d* where the first and the second inclined surfaces 319*b* and 319*c* intersect each other from the guide plate 318 is set to a height of a position higher than half the allowable maximum thickness M of the booklet BT conveyed along the conveying path 300. This structure enables the trailing end of the booklet BT to be pushed by the first inclined surface 319*b* having the upward inclination, and thus, the deflection can be directed downward in a reliable manner.

4) The cutting unit 300*b* is provided between the positioning stopper 317 and the jogger 319, and the end of the booklet BT that has been subjected to the skew correction is cut by the upper cutting blade 305 and the lower cutting blade 307 in the cutting unit 300*b*. Therefore, a bookbinding process can be performed with the end cleanly trimmed.

5) The skew correction device according to the present embodiment is provided in the cutter 3 of the image forming system including the image forming apparatus PR, the first post-processing apparatus 1, the second post-processing apparatus (saddle-stitching apparatus) 2, and the third post-processing apparatus (cutter) 3. Accordingly, the steps of forming an image on each sheet, aligning a bundle of sheets, saddle-stitching and middle-folding the bundle of sheets, and then cutting the end thereof can be performed as a series of processes, and thus, an efficient simple bookbinding process can be performed with the end neatly trimmed.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A skew correction device for aligning a booklet that is a folded bundle of sheets on a conveying path, the skew correction device comprising:

a first member against which a leading end of the booklet abuts in a conveying direction, the first member being configured to project in the conveying direction;

a second member configured to push a trailing end of the booklet in the conveying direction so that the leading end of the booklet abuts against the first member;

a deflection generating member including a lower surface and upper surface between which the booklet is conveyed, the deflection generating member configured to provide a deflection force along at least a center portion of the booklet with respect to the conveying direction for an entity of the booklet's travel in the conveying direction toward the first member to deflect the center portion of the booklet downward when the trailing end is pushed toward the first member; and a processor configured to, set a distance between the lower surface and the upper surface of the deflection generating member to a first distance, when the second member pushes the trailing end of the booklet in the conveying direction, the first distance being a distance that provides a minimal frictional force sufficient to convey the booklet, the first distance being determined based on a thickness of the booklet, stop the sheet from being conveyed in the conveying direction and set the distance between the lower surface and the upper surface to a second distance, when the leading end of the booklet reaches a desired distance short of the first member, the second distance being less than the first distance and such that the frictional force is increased to a level that forces the sheets to align upon further movement in the conveying direction, and set the distance between the lower surface and the upper surface to a third distance, when the leading end of the booklet abuts against the first member, the third distance being less than the second distance such that the booklet is compressed after the booklet abuts against the first member.

2. The skew correction device according to claim 1, wherein the second member has a pressing surface that is provided in a portion of the second member that abuts against the booklet, and a cross section of the pressing surface has a recessed shape.

3. The skew correction device according to claim 2, wherein the pressing surface has a first inclined surface having an upward inclination such that an upstream side in the conveying direction is located above a downstream side and a second inclined surface having a downward inclination such that the upstream side in the conveying direction is located below the downstream side, and a height of an intersection where the first and the second inclined surfaces intersect one another from an upper surface of a guide plate is set to be higher than half an allowable maximum thickness of the booklet conveyed along the conveying path.

4. The skew correction device according to claim 1, further comprising a cutting unit configured to cut an end of the booklet, the cutting unit being provided between the first member and the second member.

5. An image forming system comprising the skew correction device according to claim 1.

6. A skew correction method for aligning a booklet that is a folded bundle of sheets on a conveying path, the skew correction method comprising:

projecting a first member on the conveying path;

pushing a trailing end of the booklet with a second member against the first member projecting on the conveying path so that a leading end of the booklet abuts against the first member; and providing, via a deflection generating member having a lower surface and upper surface between which the booklet is conveyed, a deflection force along at least a center portion of the booklet with respect to the conveying direction for an entity of the booklet's travel in the conveying direction toward the first member to deflect the center portion of the booklet downward when the trailing end of the booklet is pushed toward the first member at the pushing, the providing the deflection force including, setting a distance between the lower surface and the upper surface of the deflection generating member to a first distance, when the second member pushes the trailing end of the booklet in the conveying direction, the first distance being a distance that provides a minimal frictional force sufficient to convey the booklet, the first distance being determined based on a thickness of the booklet, stopping the sheet from being conveyed in the conveying direction and setting the distance between the lower surface and the upper surface to a second distance, when the leading end of the booklet reaches a desired distance short of the first member, the second distance being less than the first distance and such that the frictional force is increased to a level that forces the sheets to align upon further movement in the conveying direction, and setting the distance between the lower surface and the upper surface to a third distance, when the leading end of the booklet abuts against the first member, the third distance being less than the second distance such that the booklet is compressed after the booklet abuts against the first member.

* * * * *